US010555629B2

(12) United States Patent
Miksovsky et al.

(10) Patent No.: US 10,555,629 B2
(45) Date of Patent: Feb. 11, 2020

(54) EATING UTENSIL SYSTEM

(71) Applicant: humangear, Inc., San Francisco, CA (US)

(72) Inventors: Christopher A. Miksovsky, San Francisco, CA (US); Clint N. Slone, San Francisco, CA (US); Evelyne Chaubert, San Francisco, CA (US); Charlie Nghiem, Oakland, CA (US); Robert Charles Lane, Larkspur, CA (US); Jonathan Paul Downing, Belmont, CA (US)

(73) Assignee: humangear, Inc., San Francisco, CA (US)

( * ) Notice: Subject to any disclaimer, the term of this patent is extended or adjusted under 35 U.S.C. 154(b) by 0 days.

(21) Appl. No.: 16/213,466

(22) Filed: Dec. 7, 2018

(65) Prior Publication Data

US 2019/0110620 A1 Apr. 18, 2019

Related U.S. Application Data

(62) Division of application No. 15/268,175, filed on Sep. 16, 2016, now abandoned, which is a division of (Continued)

(51) Int. Cl.

| | |
|---|---|
| ***A47G 21/06*** | (2006.01) |
| ***A47G 21/02*** | (2006.01) |
| ***A47G 21/04*** | (2006.01) |

(52) U.S. Cl.

CPC ..... *A47G 21/06* (2013.01); *A47G 21/023* (2013.01); *A47G 21/04* (2013.01)

(58) Field of Classification Search

CPC ..... A47G 21/02; A47G 21/023; A47G 21/04; A47G 21/06; A47G 21/08; A47J 43/28–282

(Continued)

(56) References Cited

U.S. PATENT DOCUMENTS

| | | | |
|---|---|---|---|
| 32,916 | A | 7/1861 | Richards |
| 33,703 | A | 11/1861 | Hardie |

(Continued)

FOREIGN PATENT DOCUMENTS

| | | |
|---|---|---|
| CN | 2231889 | 7/1996 |
| CN | 2373000 | 4/2000 |

(Continued)

OTHER PUBLICATIONS

Light My Fire Spork Medium BPA-Free Tritan Spork with Full-Sized Spoon, Fork and Serrated Knife Edge, Dec. 2, 2009; https://www.amazon.com/Light-Fire-BPA-Free-Full-Sized-Serrated/dp/B00B5A2YX0/ref=sr_1_2_sspa?ie=UTF8&qid=1544804816&sr=8-2-spons&keywords=light+my+fire+spork&psc=1.*

(Continued)

*Primary Examiner* — Jason Daniel Prone

(74) *Attorney, Agent, or Firm* — Beyer Law Group LLP

(57) ABSTRACT

A combination spoon and fork system capable of being stored in a nested configuration or used as a combination eating utensil with the spoon and fork connected end to end. An interlocking mechanism can interlock the spoon and fork in either the nested position or in the end to end configuration. The interlocking system allows the handle of the spoon to slide between rails on the handle of the fork and to snap and lock the spoon in place either nested with the fork or end to end with the fork to form an elongated combination eating utensil. The spoon and fork of the system can also be used separately from one another.

23 Claims, 24 Drawing Sheets

Related U.S. Application Data application No. 14/204,497, filed on Mar. 11, 2014, now Pat. No. 9,468,321.

(58) Field of Classification Search
USPC ..... 30/147–150, 322–328; D7/643, 644, 653
See application file for complete search history.

(56) References Cited

U.S. PATENT DOCUMENTS 34,069 A 1/1862 Neill
34,098 A 1/1862 Hardie et al.
34,712 A 3/1862 Cables
46,832 A 3/1865 Thorne
88,370 A 3/1869 Cox
RE7,925 E 10/1877 Ulmer
RE9,687 E 5/1881 Cox
398,264 A 2/1889 Kisner
D30,129 S * 2/1899 Whitcomb et al. ..... D7/644
D31,575 S 10/1899 Phillips et al.
671,740 A 4/1901 Wattne
675,475 A 6/1901 Glover
812,424 A 2/1906 Hellmuth
849,098 A 4/1907 Aufrichtig
854,745 A 5/1907 King
870,413 A 11/1907 Brown
972,777 A 10/1910 Richardson
1,053,387 A 2/1913 Hawley
1,229,696 A 6/1917 Woods
1,271,679 A 7/1918 Duckett
1,277,205 A 8/1918 Evans
D53,165 S 4/1919 Janosik
1,337,174 A 4/1920 Whyte
1,348,762 A 8/1920 Suzuki
1,372,325 A 3/1921 Willemin
D59,869 S * 11/1921 Quandee et al. ..... 30/150
D60,369 S 2/1922 Quandee et al.
1,425,750 A 8/1922 Crawford
1,452,337 A 4/1923 Brecel
D63,047 S 9/1923 Adler
1,699,248 A 1/1929 Pasal
1,868,289 A 7/1932 Leidel
D93,956 S 11/1934 Wilson
1,984,081 A 12/1934 Pisculli
2,010,074 A 8/1935 Fuerst
2,109,016 A 2/1938 Ringer
2,251,842 A 8/1941 Hill
2,318,129 A 5/1943 Torode
D143,431 S 1/1946 Lapin
2,439,882 A 4/1948 Beddow
2,470,492 A 5/1949 Jenkins
2,505,122 A 4/1950 Krieger, Jr.
D149,920 S 8/1950 Pavlinetz
2,542,600 A 2/1951 Vaccarezza
2,610,400 A 9/1952 Wendling
2,752,678 A 7/1956 Welch
D184,317 S 1/1959 McArthur
3,014,277 A 12/1961 Geckler
3,121,951 A 2/1964 Green
3,138,871 A 6/1964 Sears
D199,630 S 11/1964 Dedic, Sr.
D209,704 S 12/1967 Siune et al.
D210,549 S 3/1968 O'Brien
3,586,161 A 6/1971 Fong et al.
3,596,965 A 8/1971 Woofter
3,630,249 A 12/1971 Brunwin
3,771,224 A 11/1973 Bono, Jr.
3,967,376 A 7/1976 Foley
D241,302 S 9/1976 Scigliano
3,991,466 A 11/1976 Smith
D249,926 S 10/1978 Wong
4,317,284 A 3/1982 Prindle
4,377,035 A 3/1983 Dalichow
D269,060 S 5/1983 Creamer
4,425,711 A 1/1984 Wood et al.
4,524,512 A 6/1985 Formo et al.
D284,442 S 7/1986 Chan
4,615,120 A 10/1986 Newman
4,625,404 A 12/1986 Valente et al.
4,771,541 A 9/1988 Bouchakian
4,835,864 A 6/1989 Tang
4,984,367 A 1/1991 Albanese
4,995,154 A 2/1991 Bamber
D318,300 S 7/1991 Lillelund et al.
D318,600 S 7/1991 Lillelund et al.
D325,855 S 5/1992 Rea, Sr.
5,197,623 A 3/1993 Wang
D342,422 S 12/1993 Sanford
D347,975 S 6/1994 Zeller
5,327,650 A 6/1994 Rojas
D362,160 S 9/1995 Brabeck et al.
5,542,181 A 8/1996 Gaylord
D376,514 S 12/1996 Torkelson
D388,664 S 1/1998 Gagnon et al.
D391,123 S 2/1998 Rey et al.
5,735,050 A 4/1998 Hsieh
D396,613 S 8/1998 Cousins
D401,481 S 11/1998 Boilard et al.
5,845,403 A 12/1998 Nivin
5,904,250 A 5/1999 De Schutter
D412,813 S 8/1999 Roskind et al.
5,940,974 A 8/1999 Lee
D414,988 S 10/1999 Santini
6,145,204 A 11/2000 Cash
6,151,999 A * 11/2000 Eklind ..... B25B 13/56 7/138
6,463,662 B1 10/2002 Coscia et al.
6,647,828 B2 11/2003 Hakim
D491,419 S 6/2004 White et al.
D509,708 S 9/2005 Schmidt
7,013,568 B2 3/2006 Schmidt
D530,985 S 10/2006 Evans
D530,986 S 10/2006 Lago-Arenas
D533,034 S 12/2006 Wasserman
D535,857 S 1/2007 Bristow
D536,221 S 2/2007 Kamins
D536,222 S 2/2007 Heiberg et al.
D537,302 S 2/2007 Vrhovski
D554,951 S 11/2007 McGrath
D563,737 S 3/2008 Shane-Schuldt
D575,593 S 8/2008 Svartström
D587,075 S 2/2009 Dibnah et al.
D608,602 S 1/2010 Davies et al.
D609,060 S 2/2010 Pallotto
D612,692 S 3/2010 Menceles
D617,156 S 6/2010 Griffith
D618,070 S 6/2010 Jalet et al.
D625,153 S 10/2010 Gallop et al.
7,816,634 B1 10/2010 Guide, Jr. et al.
7,856,722 B2 12/2010 Lago-Arenas
D633,344 S 3/2011 Nordwall
D637,309 S 5/2011 Park
D656,799 S 4/2012 Lebeau
8,296,957 B2 10/2012 Muehlemann
D673,431 S 1/2013 Glavin et al.
D676,286 S 2/2013 Lion et al.
D686,045 S 7/2013 Stewart et al.
D690,156 S 9/2013 Apple et al.
8,635,780 B1 1/2014 Abul
8,689,453 B2 4/2014 Vogan
D705,020 S 5/2014 Fraser et al.
8,726,525 B2 5/2014 Bagley et al.
D706,586 S 6/2014 Kestenbaum
8,839,522 B2 9/2014 Walters
D718,093 S 11/2014 Miksovsky et al.
D722,837 S 2/2015 Miksovsky et al.
D730,049 S 5/2015 Miksovsky et al.
9,061,429 B2 6/2015 Barber
D739,685 S 9/2015 Miksovsky et al.
D740,079 S 10/2015 Miksovsky et al.
D745,339 S 12/2015 Cetti
D746,644 S 1/2016 Cai
D747,159 S 1/2016 Frost
D752,918 S 4/2016 Katopis
D753,447 S 4/2016 Busboom

(56) References Cited

U.S. PATENT DOCUMENTS

| | | | |
|---|---|---|---|
| D756,171 | S | 5/2016 | Mou |
| D756,172 | S | 5/2016 | Mou |
| D758,808 | S | 6/2016 | Gatewood |
| 9,434,590 | B2 | 9/2016 | Miksovsky et al. |
| 9,468,321 | B2 | 10/2016 | Miksovsky et al. |
| 9,549,626 | B2 | 1/2017 | Truog et al. |
| D782,254 | S | 3/2017 | Joseph |
| D794,400 | S | 8/2017 | Young |
| D807,127 | S | 1/2018 | Levi |
| D812,994 | S | 3/2018 | Mundhra |
| D812,995 | S | 3/2018 | Mundhra |
| D813,616 | S | 3/2018 | Mundhra |
| D816,432 | S | 5/2018 | Huang |
| D825,104 | S | 8/2018 | Simard et al. |
| D828,730 | S | 9/2018 | Gauss et al. |
| D834,887 | S | 12/2018 | Miksovsky et al. |
| D842,662 | S | 3/2019 | Bloch et al. |
| 2003/0029044 | A1 | 2/2003 | Mattson et al. |
| 2003/0110644 | A1 | 6/2003 | Miller |
| 2005/0066531 | A1 | 3/2005 | Hougland |
| 2005/0155229 | A1 | 7/2005 | Lee |
| 2006/0248732 | A1 | 11/2006 | Straube |
| 2007/0084063 | A1 | 4/2007 | Hughes |
| 2007/0124943 | A1 | 6/2007 | Hougland |
| 2007/0251103 | A1 | 11/2007 | Rhodes, III |
| 2008/0000092 | A1 | 1/2008 | Vanguard |
| 2008/0016698 | A1 | 1/2008 | Simpson |
| 2008/0148575 | A1 | 6/2008 | Chan |
| 2008/0256807 | A1 | 10/2008 | Kirkup |
| 2009/0172949 | A1 | 7/2009 | Watts |
| 2009/0205209 | A1 | 8/2009 | Tovar |
| 2009/0293283 | A1 | 12/2009 | Hsu |
| 2010/0206885 | A1 | 8/2010 | Bowden et al. |
| 2010/0218382 | A1 | 9/2010 | Scott |
| 2011/0091521 | A1 | 4/2011 | Omelchenko |
| 2012/0036724 | A1 | 2/2012 | Walters |
| 2012/0297628 | A1 | 11/2012 | Rayko et al. |
| 2013/0152406 | A1 | 6/2013 | McFarland |
| 2014/0026425 | A1 | 1/2014 | Kim |
| 2015/0014329 | A1 | 1/2015 | Konopatsky |
| 2015/0257562 | A1 | 9/2015 | Miksovsky et al. |
| 2017/0000276 | A1 | 1/2017 | Miksovsky et al. |

FOREIGN PATENT DOCUMENTS

| | | | | |
|---|---|---|---|---|
| CN | 200945058 | | 9/2007 | |
| CN | 201691585 | | 1/2011 | |
| CN | 102068177 | | 5/2011 | |
| CN | 202234496 | | 5/2012 | |
| CN | 202874843 | | 4/2013 | |
| CN | 203424719 | | 2/2014 | |
| DE | 44 17 037 | | 12/1998 | |
| EP | 0 129 495 | | 12/1984 | |
| GB | 22788 | | 9/1915 | |
| GB | 1337613 | A * | 11/1973 | ..... F16B 7/0446 |
| WO | WO 2013/095407 | | 6/2013 | |
| WO | WO 2015/138218 | | 9/2015 | |

OTHER PUBLICATIONS

Alite, Cloverware Lite, http://shop.alitedesigns.com/cloverware-lite.html, downloaded on Mar. 6, 2014.
Alite, Cloverware 2.0, http://shop.alitedesigns.com/cloverware-538.html, downloaded on Mar. 6, 2014.
Guyot, Microbites™, https://www.guyotdesigns.com/product-microbites/, downloaded on Mar. 6, 2014.
Guyot, Utensils, https://www.guyotdesigns.com/utensils/, downloaded on Mar. 6, 2014.
International Search Report dated Jul. 8, 2015 from International Application No. PCT/US2015/019017.
Written Opinion dated Jul. 8, 2015 from International Application No. PCT/US2015/019017.
Chinese Office Action dated Apr. 27, 2017 from Chinese Application No. 201580022197.1.
Chinese Office Action dated Aug. 1, 2017 from Chinese Application No. 201611163525.2.
European Search Report dated Jun. 16, 2017 from European Application No. 16202786.3-1653.
European Office Action dated Oct. 17, 2018 from European Patent Application No. 16 202 786.6-1011.
Light My Fire, Spork original, http://www.lightmyfire.com/products/products/spork/spork-original.aspx, downloaded on Mar. 6, 2014.
Primus, Folding Spork, http://store.primuscamping.com/cookware/utensils-and-accessories/primus-folding-spork-black/, downloaded on Mar. 6, 2014.
DCI, Swivel Spork & Knife Set, http://shop.dcigift.com/p/swivel-spork-knife-set, downloaded on Mar. 6, 2014.
Miksovsky et al., U.S. Appl. No. 16/213,536, filed Dec. 7, 2018.
Chinese Office Action dated Aug. 2, 2019 from Chinese Application No. 201810024557.7.
U.S. Office Action dated May 7, 2019 from U.S. Appl. No. 16/213,536.
MSR Folding Camp Utensils, https://www.msrgear.com/cookware/folding-utensils, downloaded on Sep. 20, 2018.
GSI Outdoors, Telescoping Foon, http://www.gsioutdoors.com/telescoping-foon.html, downloaded on Sep. 20, 2018.
GSI Outdoors, Pivot Spatula, http://www.gsioutdoors.com/pivot-spatula.html, downloaded on Sep. 20, 2018.
Miksovsky et al., U.S. Appl. No. 29/653,612, filed Jun. 16, 2018.
Miksovsky et al., U.S. Appl. No. 29/653,595, filed Jun. 15, 2018.
Miksovsky et al., U.S. Appl. No. 16/439,425, filed Jun. 12, 2019.
U.S. Final Office Action dated Sep. 16, 2019 from U.S. Appl. No. 16/213,536.
Extended European Search Report dated Oct. 22, 2019 from European Application No. 18208165.3-1011/3488740.

* cited by examiner

EATING UTENSIL SYSTEM

CROSS-REFERENCE TO RELATED APPLICATIONS

This application is a Divisional of U.S. application Ser. No. 15/268,175, filed on Sep. 16, 2016. U.S. application Ser. No. 15/268,175 is a Divisional of U.S. application Ser. No. 14/204,497, filed on Mar. 11, 2014 (now U.S. Pat. No. 9,468,321), which is related to U.S. Design Applications No. 29/484,447, filed on Mar. 10, 2014, all of which are incorporated herein by reference in their entirety.

BACKGROUND OF THE INVENTION

The present invention relates generally to eating utensils. More particularly, the invention relates to combination eating utensils that may be suitable for transport.

Eating utensils are used by people all over the world to bring food to their mouths. Sometimes, eating utensils, such as knives, are used to cut food to a size and shape suitable for placing in a person's mouth. In some Asian countries, chopsticks are typically the only eating utensils used although spoons are also used for soups in Asia. In Western countries, forks, knives, and spoons are typically used as eating utensils. In still other countries, such as India and Ethiopia, hands are often used in place of utensils.

Although these existing utensils work quite well, there are continuing efforts to develop new hybrid combinations of utensils that provide not only improved function and convenience but can also reduce the need for separate utensils. Such combination utensils are also more easily transported, as they take up less space.

SUMMARY OF THE INVENTION

In accordance with an embodiment, a combination fork and spoon system is provided. The combination fork and spoon system includes a fork and a spoon. The fork includes a recess in a bottom surface and a pair of rails. Each rail is positioned along a portion of an outer edge of the bottom surface of a handle. The spoon is configured to interlock with the fork either in a nested position or in an end to end configuration to form a mm the rails.

In accordance with another embodiment, a combination eating utensil is provided. The combination eating utensil includes a fork and a spoon. The fork has a handle connected to a head portion including a plurality of tines. At least one tine on a curved outer edge of the head portion has a chamfered outer edge along substantially its entire length. The chamfered edge tapers to a point where the handle is connected to the head portion. The spoon has a substantially pentagonal bowl portion having substantially flat side and end edges. The spoon and fork can be connected at their proximal ends.

In accordance with yet another embodiment, a combination fork and spoon system is provided. The combination fork and spoon system includes a fork, a spoon, and an interlocking mechanism. The fork has a handle with a pair of rails along a portion of its side edges. The spoon has a handle slidable along the handle of the fork and the handle of the spoon is slidable between the rails of the fork. The interlocking mechanism is for interlocking the spoon and the fork either in a nested position or in an end to end position.

According to yet another embodiment, a fork is provided. The fork includes a head portion connected to a handle portion. The head portion includes a plurality of tines. An outer tine has a curved chamfered outer edge that extends along substantially an entire length of the head portion. The chamfered edge tapers to a point where the handle portion meets the head portion.

BRIEF DESCRIPTION OF THE DRAWINGS

The invention, together with further objects and advantages thereof, may best be understood by reference to the following description taken in conjunction with the accompanying drawings in which.

DETAILED DESCRIPTION OF THE PREFERRED EMBODIMENTS

The present invention relates generally to combination eating utensils.

Referring to FIGS. 1-6, a combination spoon and fork system in accordance with one embodiment of the invention will be described. In the illustrated embodiment, the combination spoon and fork system 100 includes a spoon 110 and a fork 140 that can nest together for storage and transport. To form a single, longer combination utensil with a spoon on one end and a fork on the other end, the proximal ends of the spoon 110 and fork 140 can slide together and lock in place. A low profile interlocking mechanism is used to interlock the spoon 110 and the fork 140 in both the nested position and in the combination utensil mode. The spoon 110 and fork 140 can also be separated completely and used separately.

Figure 1A:
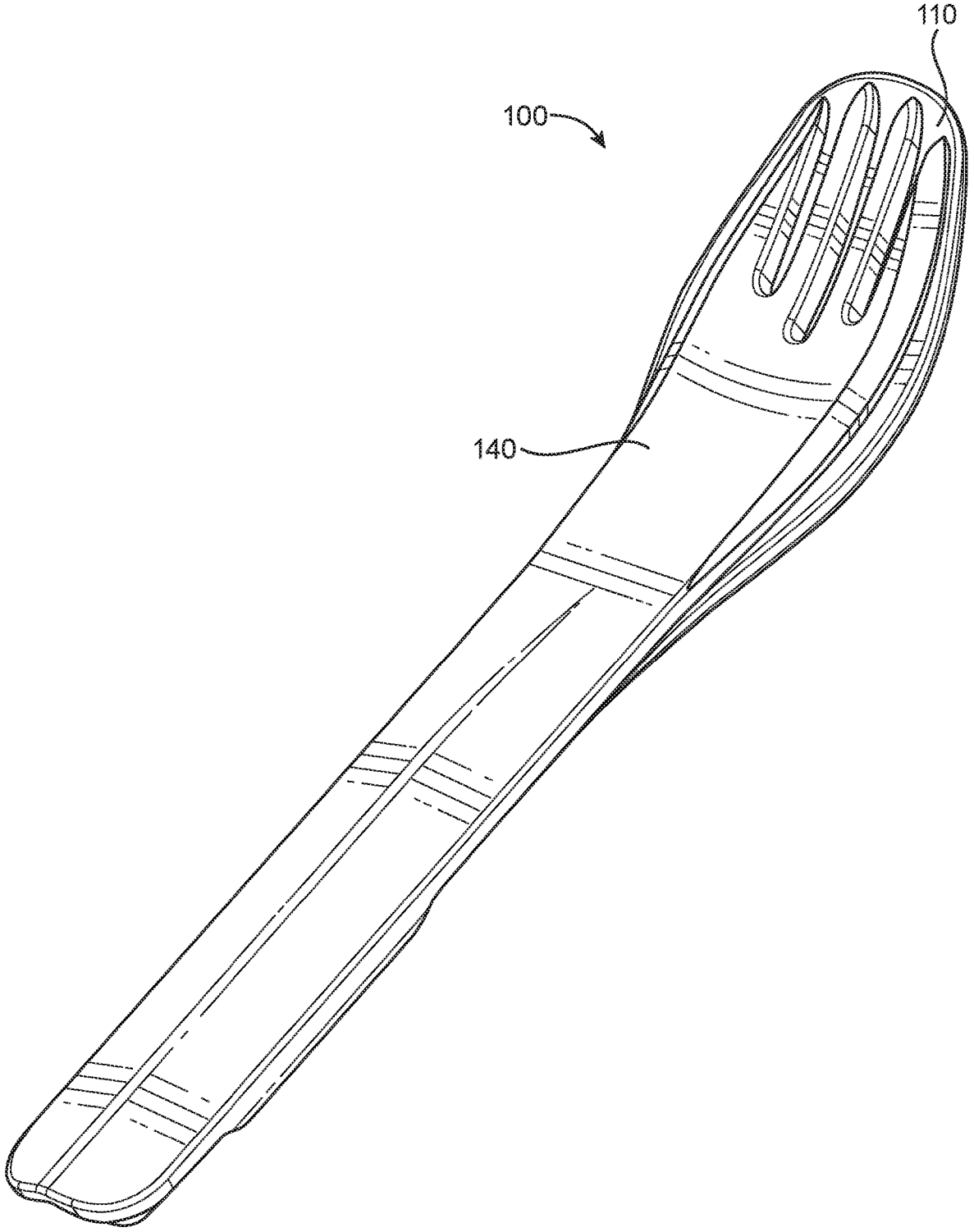
FIG. 1A is a top perspective of a combination spoon and fork system in its nested position in accordance with an embodiment.
Figure 1B:
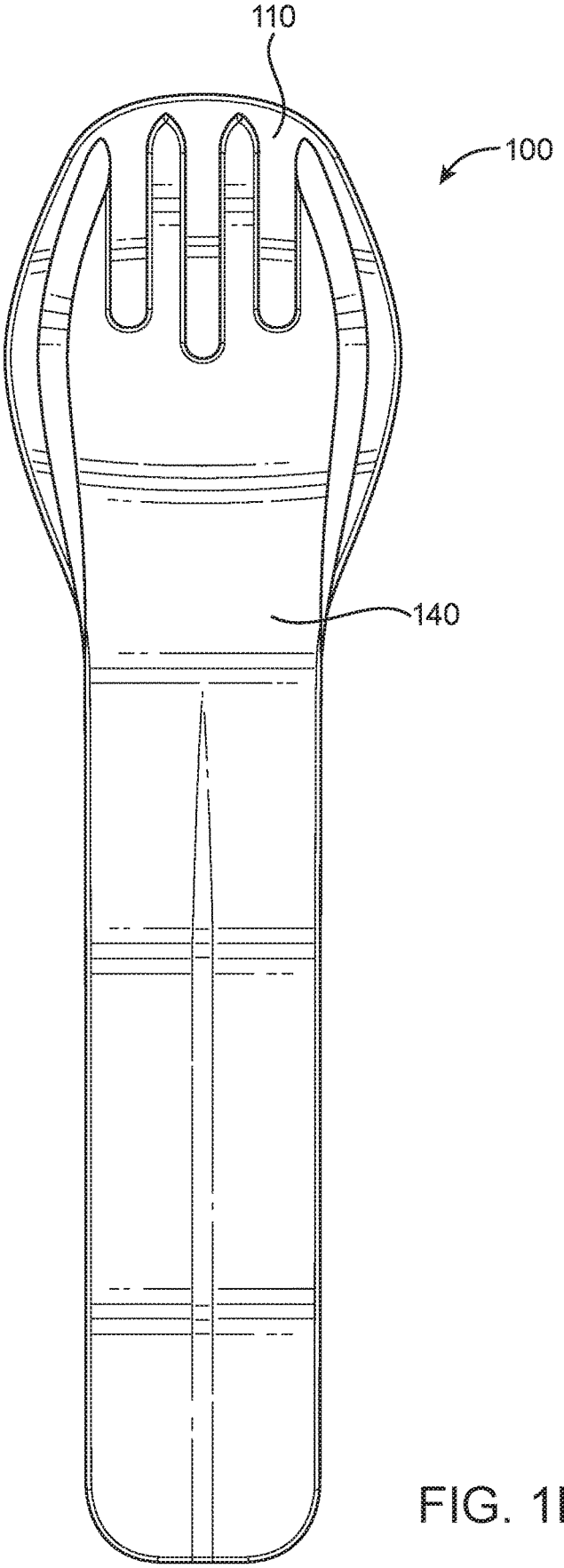
FIG. 1B is a top plan view of the combination spoon and fork system shown in FIG. 1A in its nested position.
Figure 2A:
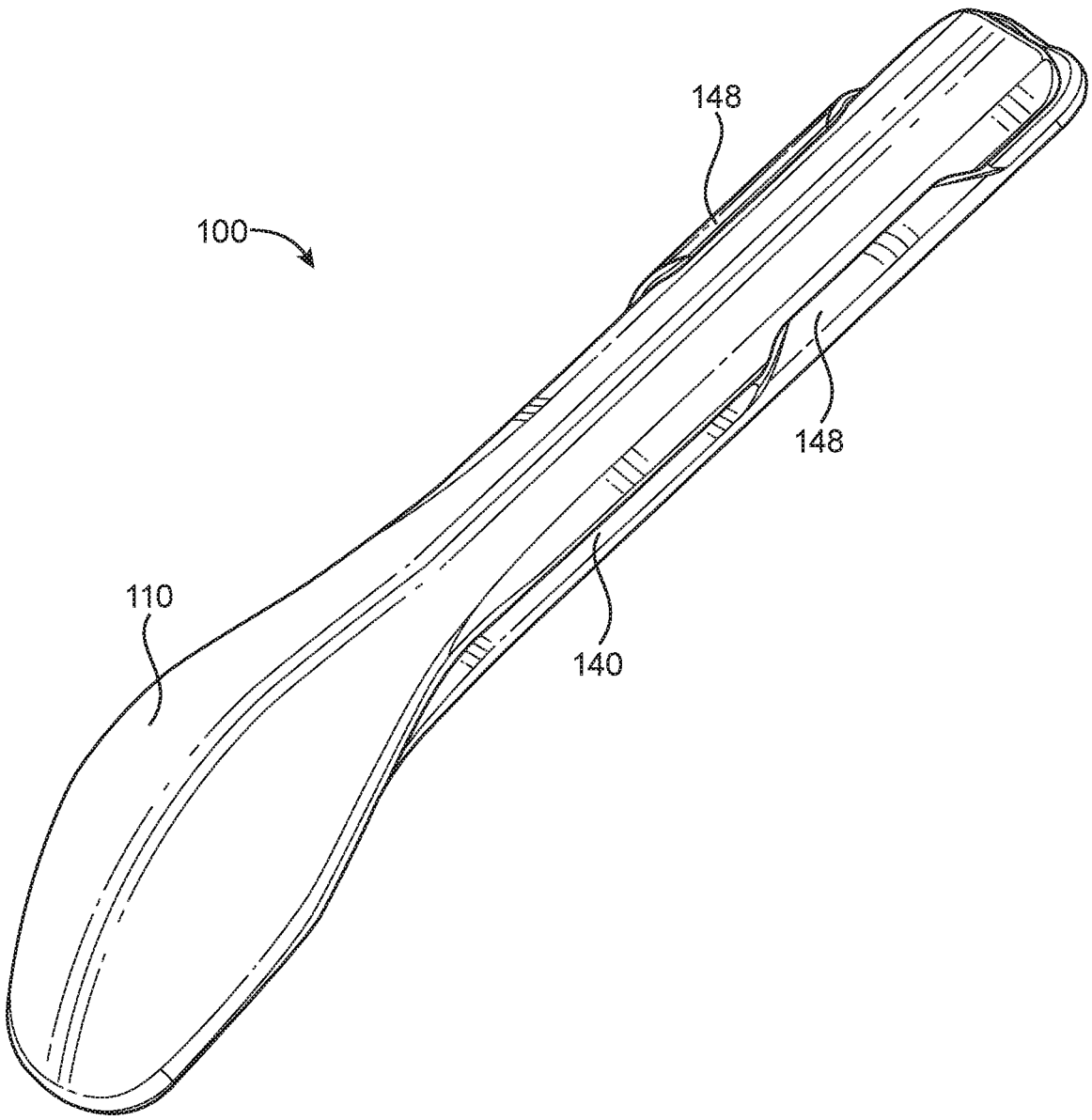
FIG. 2A is a bottom perspective view of the embodiment shown in FIG. 1 in its nested position.
Figure 2B:
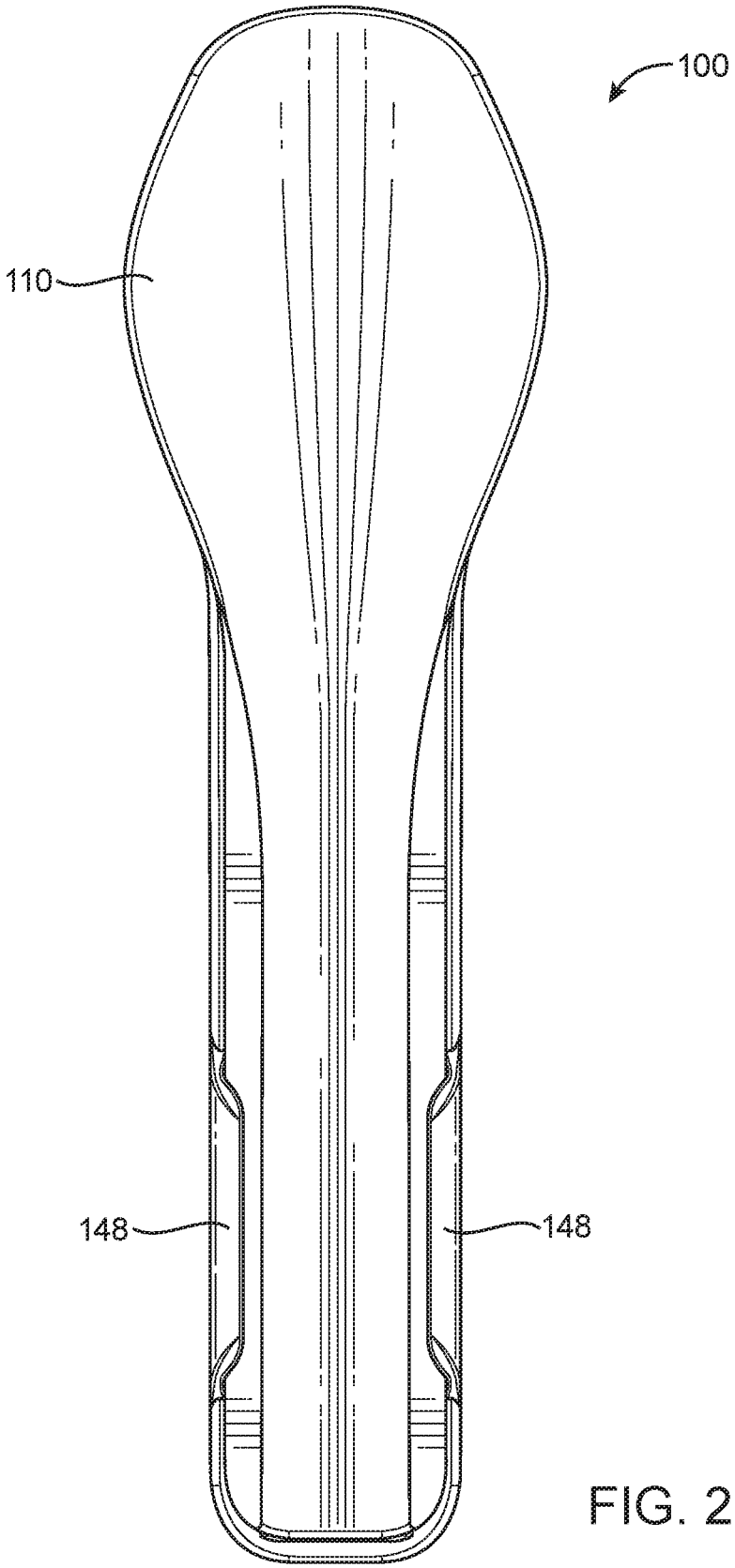
FIG. 2B is a bottom plan view of the embodiment shown in FIG. 1 in its nested position.

FIGS. 1A and 1B are top perspective and top plan views, respectively, of the combination spoon and fork system 100 in its nested position, in accordance with an embodiment. FIGS. 2A and 2B are bottom perspective and bottom plan views, respectively, of the spoon and fork system 100 in its nested position.

Figure 3:
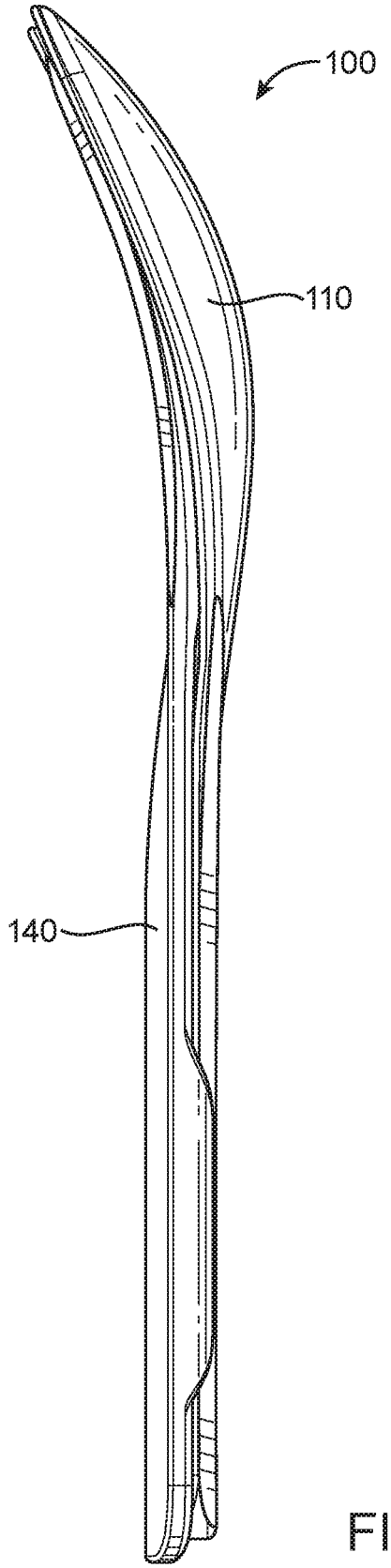
FIG. 3 is a side view of the embodiment shown in FIGS. 1 and 2.

As shown in FIGS. 1-3, the spoon 110 and fork 140 can be nested together in a low profile manner for convenient storage and transport. FIG. 3 is a side view of the combination spoon and fork system 100, which illustrates the low profile nature of the spoon and fork system 100 nested position. In the illustrated embodiment, the fork 140 is nested over the spoon 110.

Figure 4A:
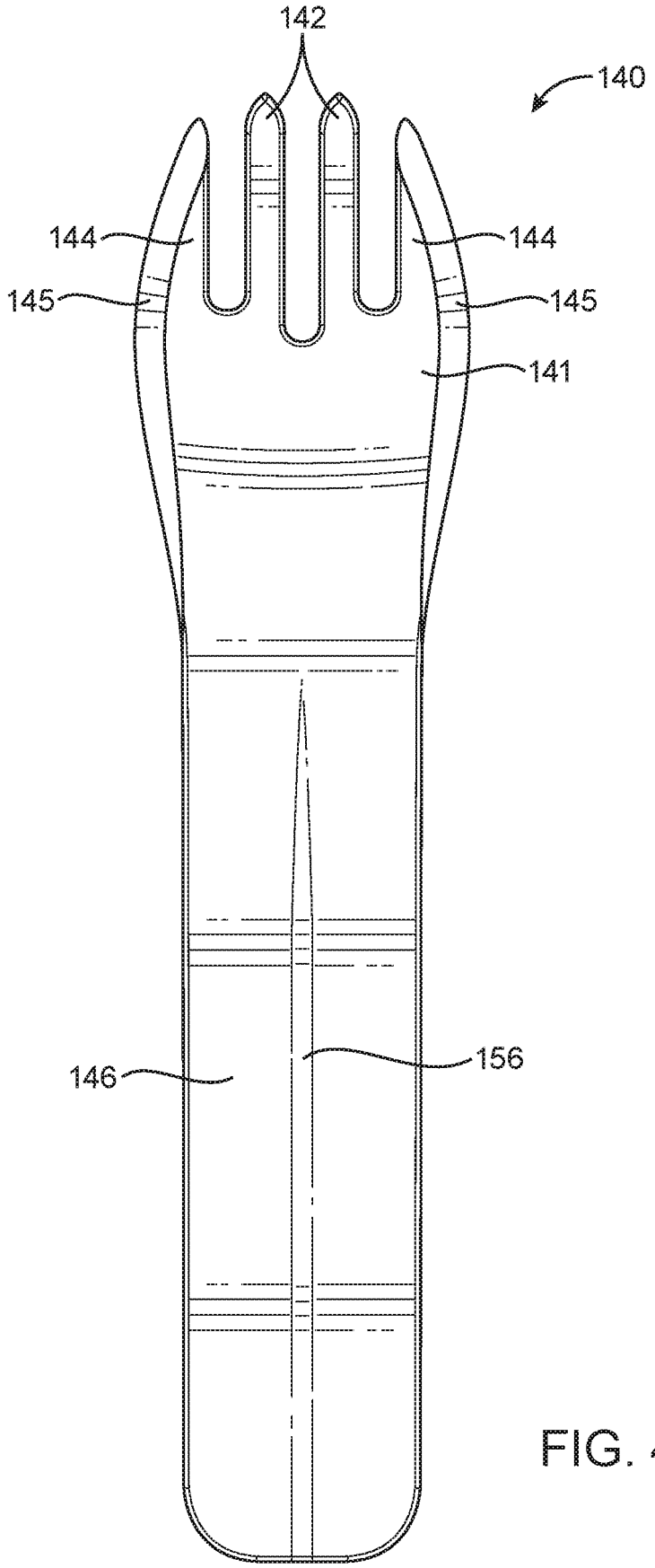
FIG. 4A is a top plan view of the fork separated from the spoon of the embodiment shown in FIGS. 1-3.
Figure 4B:
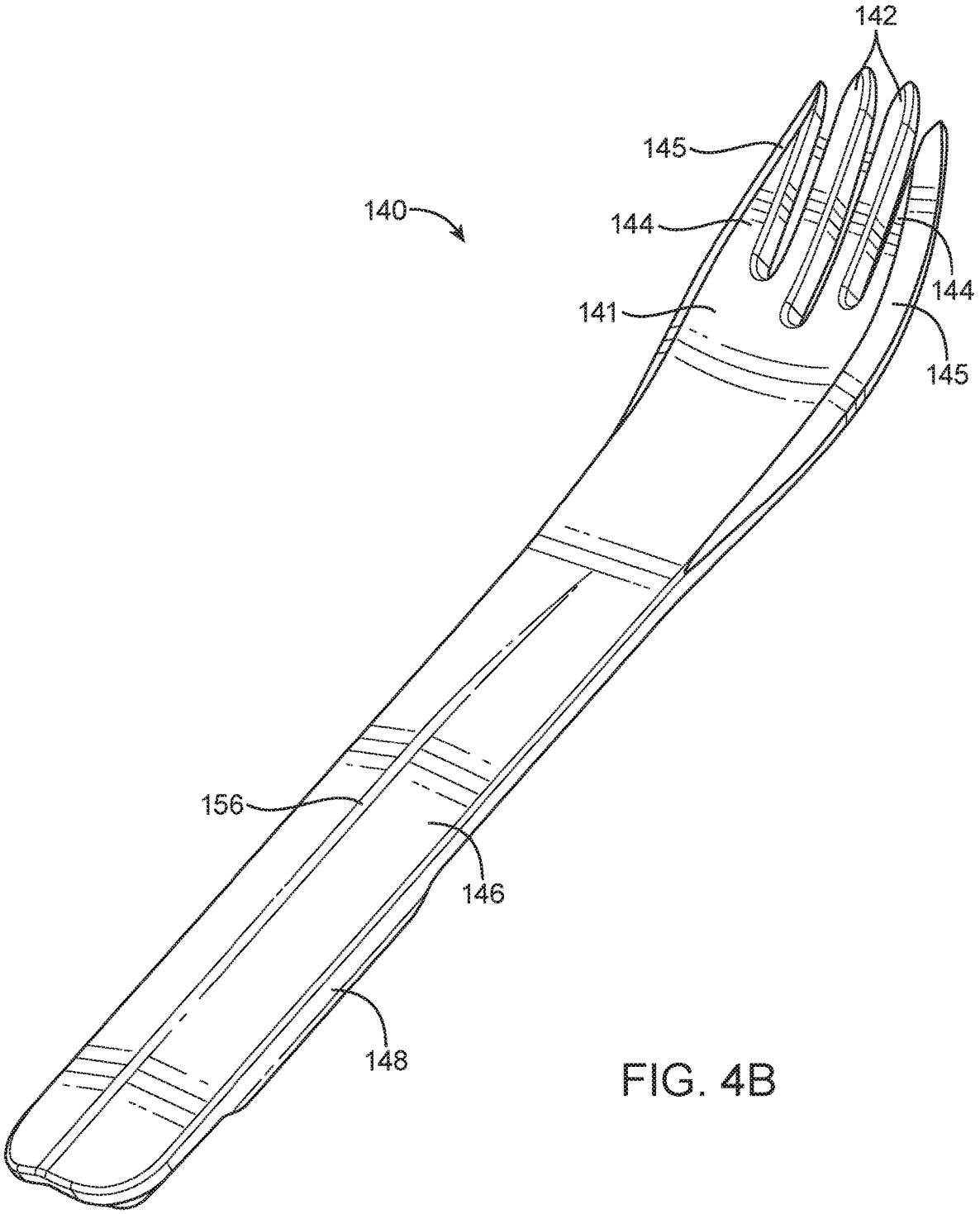
FIG. 4B is a top perspective view of the fork separated from the spoon of the embodiment shown in FIGS. 1-3.

As discussed above, the spoon 110 and the fork 140 can be separated from one another and used separately. The geometries of the fork 140 and the spoon 110 will be described below. FIGS. 4A and 4B are top plan and perspective views, respectively, of the fork 140 separated from the spoon 110. In the illustrated embodiment, the fork 140 has four tines 142, 144. It will be understood that, in other embodiments, the fork can have more or fewer tines. The fork 140 has a head portion 141, which includes the tines, that is connected to a handle 146.

Each tine 142, 144 has a sharp crest, which aids in spearing or piercing pieces of food so that the food can be picked up by the fork 140. In the illustrated embodiment, the two center tines 142 are straight and the two outer tines 144 each have a straight inner edge and a curved outer edge 145. The curved outer edges 145 of the outer tines 144 and the ends of the tines 142, 144 do not extend beyond the outer edges of the bowl portion of the spoon 110, as shown in FIGS. 1A and 1B. The curvature of the outer edges 145 can also be used for scraping food, as the curved edges 145 follow the curvature of a curved container, such as a bowl, better than the straight tines of many conventional forks.

Figure 4C:
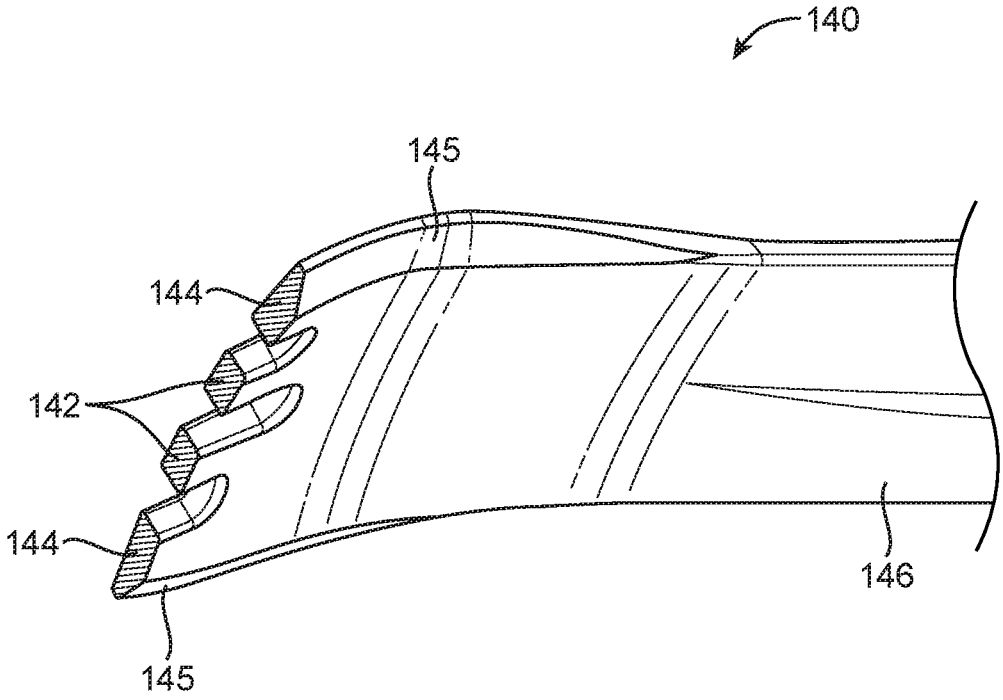
FIG. 4C is a cross-sectional perspective view of the fork shown in FIGS. 4A and 4B.

In addition to being curved, the outer edges 145 of the outer tines 144 are also tapered or chamfered such that the fork 140 can be used to cut through or separate foods that do not require a knife. The tapered or chamfered outer edges 145 are shown in the cross-sectional perspective view of FIG. 4C. As illustrated in FIG. 4C, the top surface of each of the outer edges 145 is tapered or chamfered. As illustrated, each chamfered edge 145 has one end at the tip of the outer tine 144 and extends along the outer curved edge of the outer tine 144 to the position where the fork head 141 meets the handle 146. As shown in FIGS. 4A-4C, the chamfered edge 145 spans the entire width of the outer tine 144 at the tip. As the chamfered edge 145 extends down along the curved outer edge of the outer tine 144, the width of the chamfered edge 145 remains substantially the same until it begins to taper toward the end of the fork head 141. In the illustrated embodiment, the chamfered edge 145 tapers and ends in a point where the fork head 141 meets the handle 146. Although the fork head 141 is described above as being connected to or meeting the handle 146, it will be understood that the fork is formed as an integral piece in this embodiment.

In a particular embodiment, the outer edges 145 are chamfered at an angle of about 20-25 degrees, and preferably at an angle of about 23 degrees. The outer edges 145 have an edge width of about 1 mm at its widest point. In the illustrated embodiment, the outer edges 145 of both outer tines 144 are chamfered so that both outer edges 145 can easily be used to cut or separate food regardless of whether the user is right-handed or left-handed.

In the illustrated embodiment, as shown in FIGS. 1A and 1B, a safety feature is that when the spoon 110 and fork 140 are nested, the tines 142, 144 of the fork 140 do not extend as far as the end of the spoon 110 such that the tips of the tines 142, 144 cannot poke or stab someone or something when the fork 140 and spoon 110 are in the nested position.

As shown in FIGS. 1A and 4A, the center tines 142 have a longer length than the outer tines 144 and therefore extend farther distally than the outer tines 144, thereby forming a curve at the distal end of the fork 140. The curvature of the distal end of the fork 140 can match the curvature of the distal end of the spoon 110, but as noted above, the tips of the tines 142, 144 do not extend beyond the end edge of the spoon 110 when nested. As shown in FIG. 1A, the bowl portion of the spoon 110 is slightly wider and longer than the corresponding portion of the fork 140 in the illustrated embodiment.

The handle 146 of the fork 140 will be described with reference to FIGS. 4D-4H. The handle 146 has a pair of rails 148 that extend downward from the bottom side of its two outer edges. The rails 148 aid in guiding the handle 146 of the fork 150 over the handle 114 of the spoon 110 when the spoon handle 114 is slid between the rails 148 to either place the spoon 110 and fork 140 in the nested position or slid end over end to form an elongated combination eating utensil, as will be described in more detail below. The rails 148 also secure the spoon handle 114 to the handle 146 of the fork 140, as will be explained in more detail below. As shown in the side view of FIGS. 3 and 6D, the rails 148 are very low profile, as they do not extend below the lowest bottom surface of the spoon handle 114 when the fork 140 and spoon 110 are either nested together or slid end over end to form the elongated combination eating utensil. FIGS. 2A, 2B, 6B and 6C show that, in the illustrated embodiment, the rails 148 extend only to about halfway across the width of the chamfered edge 122 of the spoon 110. The low profile nature of the rails 148 allow more efficient stacking of the fork and spoon systems 100.

The outer edge of each rails 148 is aligned and continuous with the outer edge of the rest of the fork handle 146. Further, the rails 148 taper inward so that the portion of the handle 146 with the rails 148 does not feel different from the rest of handle 146 when the fork 140 is held in a user's hand. The inward tapering as well as the low profile nature of the rails 148 reduce the tactile impact they have on a user's hand holding the fork. That is, the handle with low profile rails 148 feels better to hold than a handle having big protuberances, edges, etc.

Figure 4D:
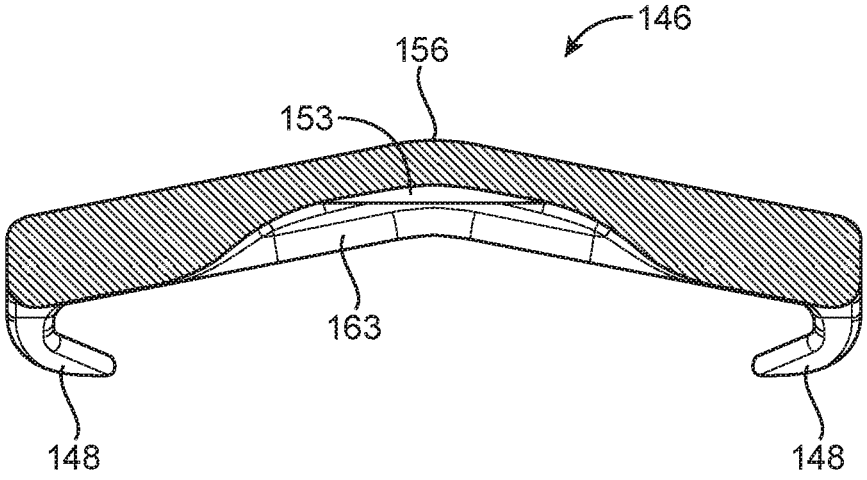
FIG. 4D is a cross-sectional end view of the handle portion of the fork shown in FIGS. 4A-4C.
Figure 4E:
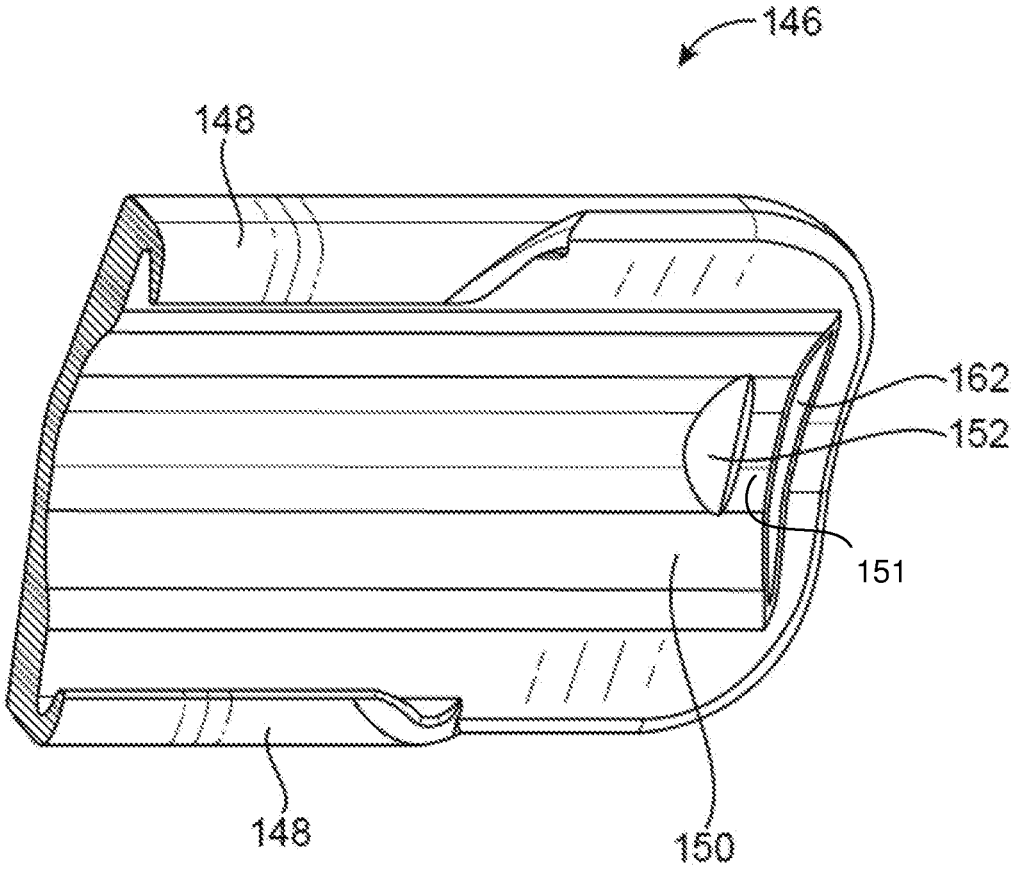
FIG. 4E is a detailed cut-away view of the handle portion of the fork shown in FIGS. 4A-4D.

As shown in FIG. 4D, the handle portion 146 of the fork 140 has a slight upside down V-shape with a ridge 156 in the center when viewed from an end. The center ridge 156 is the highest point of the handle 146 and runs down the center along substantially the entire length of the handle 146. Each side of the handle 146 angles downward from the center line to the edge at an angle of about 75-80 degrees, and preferably about 79 degrees.

Figure 4F:
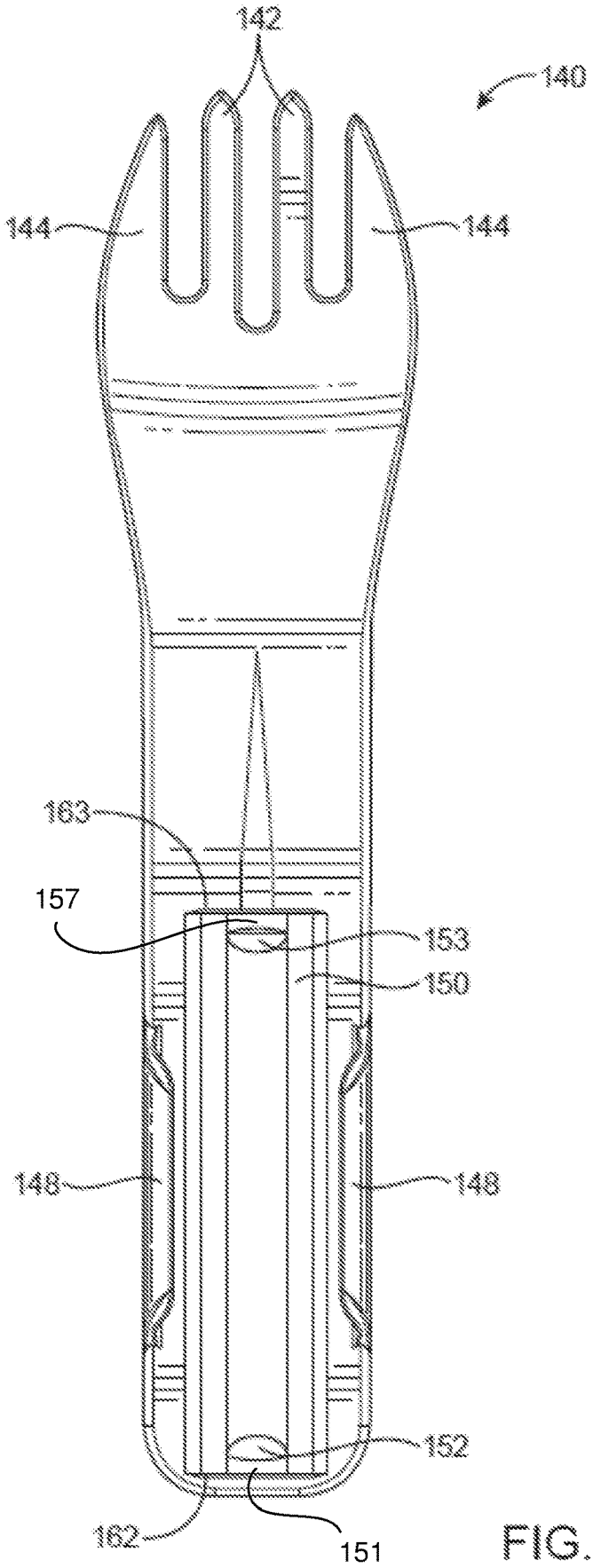
FIG. 4F is a bottom plan view of the fork shown in FIGS. 4A-4E
Figure 4G:
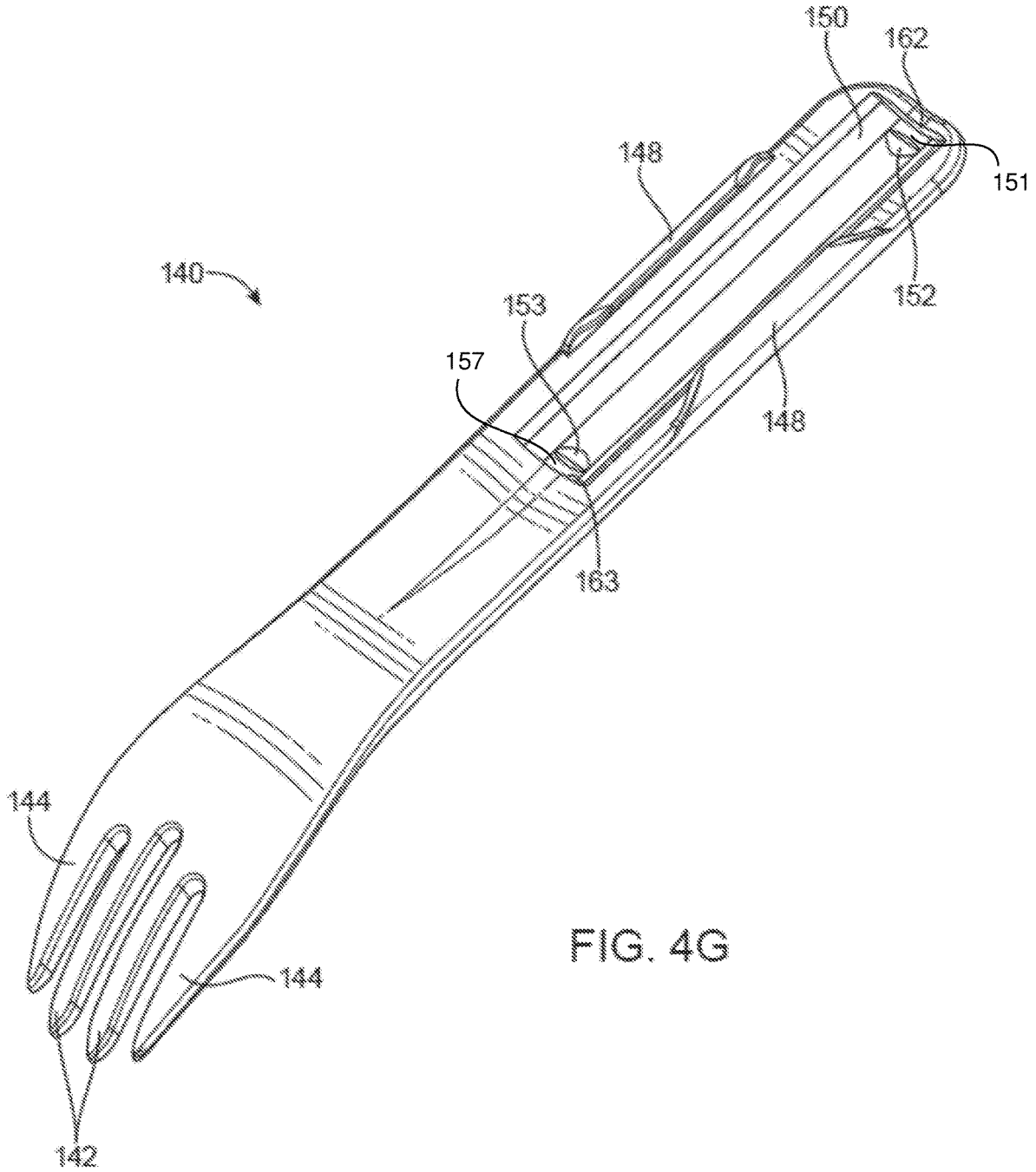
FIG. 4G is a bottom perspective view of the fork shown in FIGS. 4A-4F.
Figure 4H:
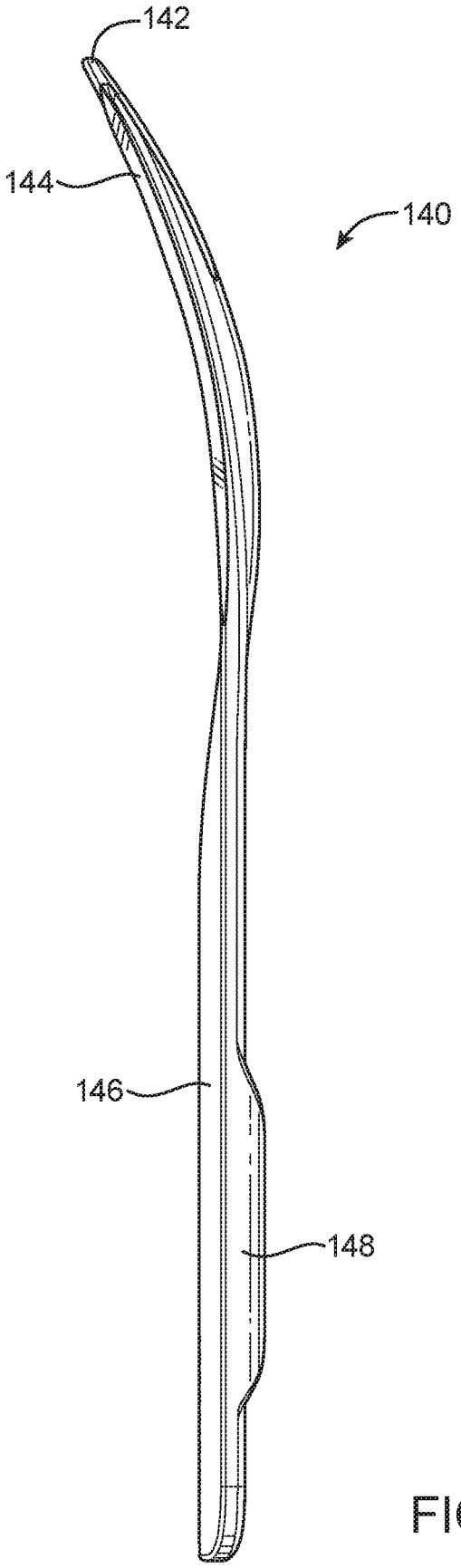
FIG. 4H is a side view of the fork shown in FIGS. 4A-4G.

The bottom of the fork handle 146 also includes a recess 150 that accommodates the contour of the top surface of the handle 114 of the spoon 110 as well as a crescent-shaped raised edge 116 on the proximal end of the spoon 110. As shown in FIGS. 4F and 4G, the recess 150 has two straight end walls 162, 163, each acting as a hard stop when the raised edge 116 of the spoon 110 abuts the end wall.

The recess 150 also includes two detents 152, 153, one near each end of the recess 150. As will be explained in more detail below, the detents 152, 153 serve to snap and lock the spoon handle 114 in place relative to the handle 146 of the fork when the spoon 110 and fork 140 are in the nested position as well as when the spoon 110 and fork 140 are attached end to end to form an elongated eating utensil, as shown in FIGS. 6A-6D.

Figure 5A:
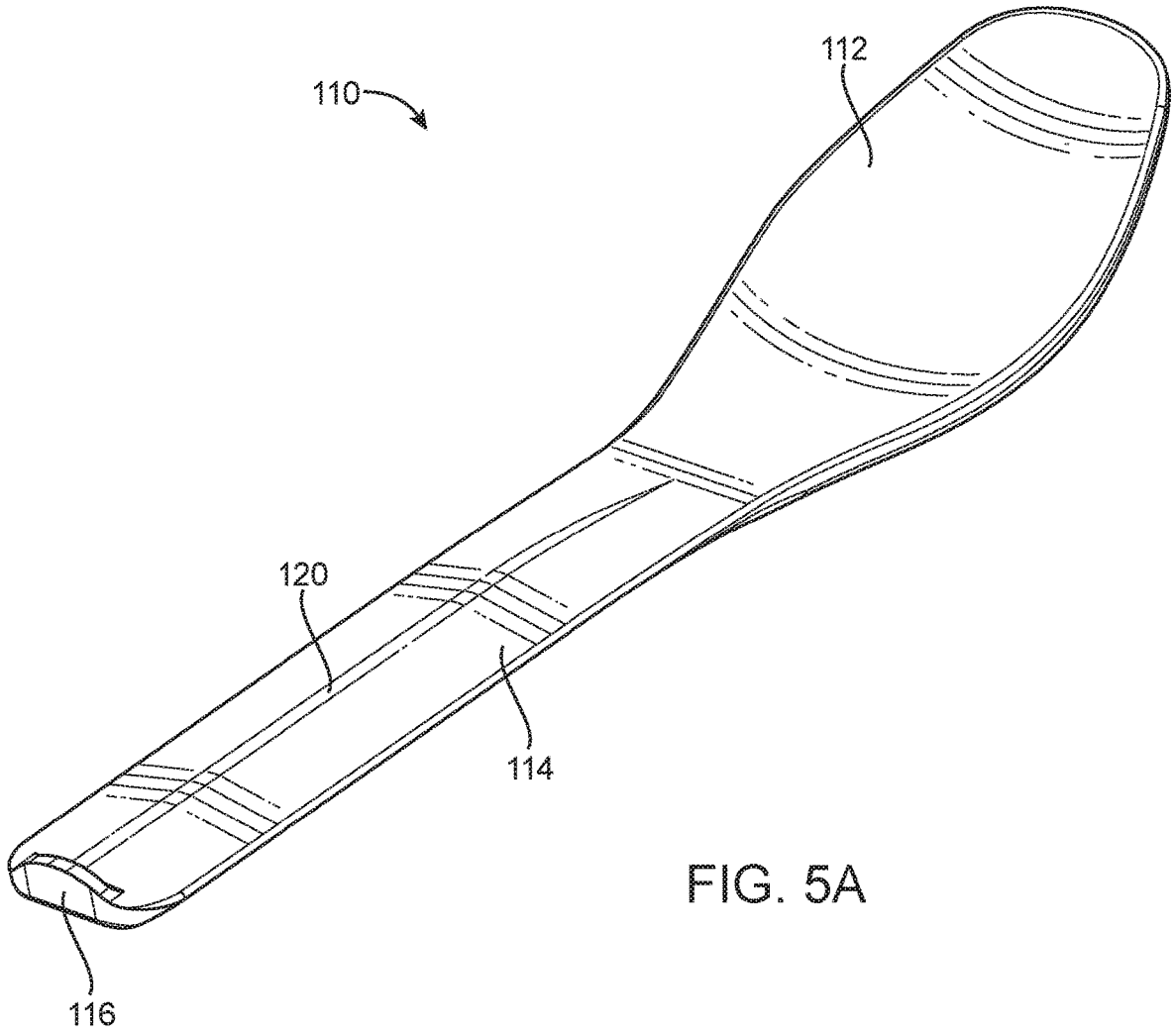
FIG. 5A is a top perspective view of the spoon separated from the fork of the embodiment shown in FIGS. 1-3.

The spoon 110 will be described below with reference to FIGS. 5A-5D. FIG. 5A is a top perspective view of the spoon 110. The spoon 110 includes a head portion or bowl 112 and a handle 114. The proximal end of the spoon handle 114 includes a crescent-shaped raised edge 116. As shown in the side view of FIG. 5D, the raised edge 116 protrudes above the top surface of the spoon handle 114.

The spoon handle 114 and the fork handle 146 are contoured similarly. As shown in FIG. 5A, the spoon handle 114 has a ridge 120 in the center. The center ridge 120 is the highest point of the handle body (excluding the raised edge 116) and runs down the center along substantially the entire length of the handle 114. Each side of the handle 114 angles downward from the center line 118 to the edge at an angle of about 75-80 degrees, and preferably about 79 degrees.

Figure 5B:
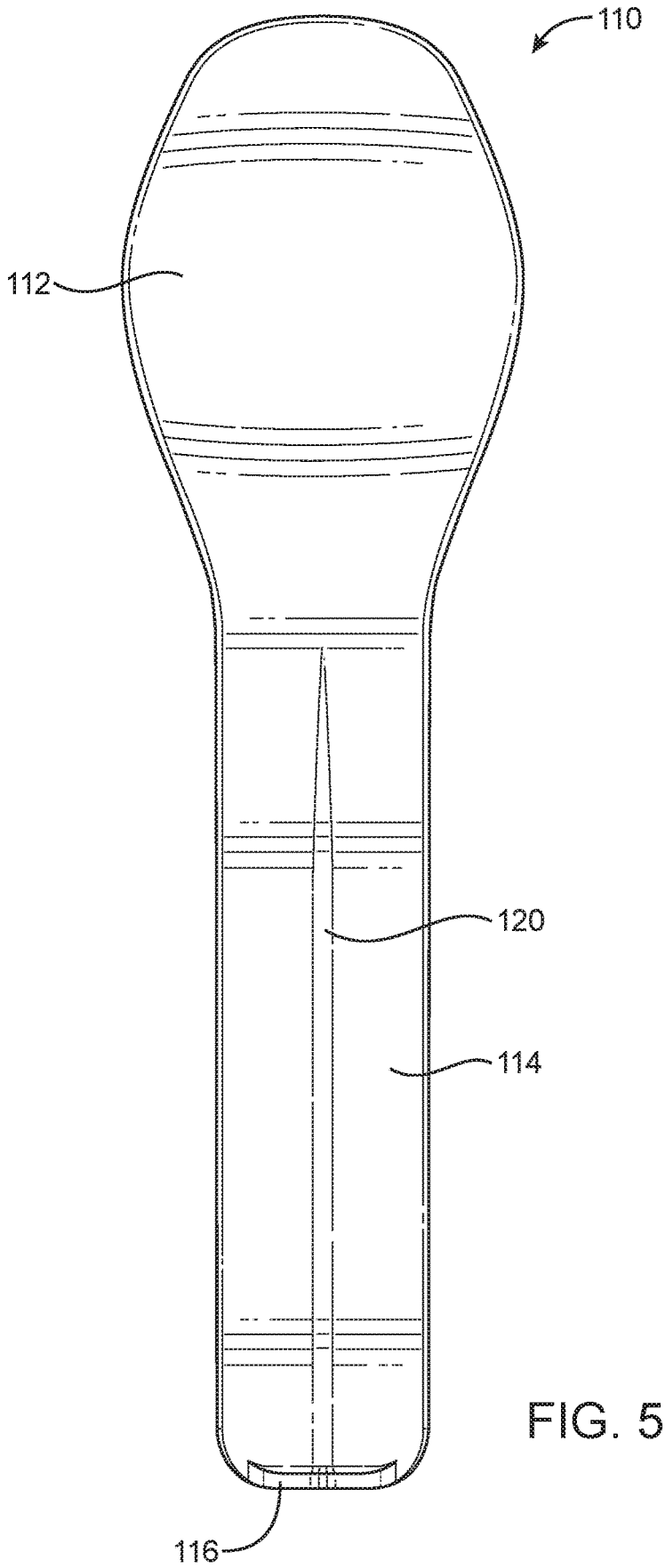
FIG. 5B is a top plan view of the spoon shown in FIG. 5A.

The bowl 112 of the spoon 110 has a substantially flat side edge 118, which allows for "scraping" food from of a container (e.g., a yogurt container) or a bowl. A conventional spoon typically has a rounded edge that is not particularly effective for scraping. As illustrated, the side edge 118 and front edge 118*b* of the bowl 112 of the spoon 110 is substantially flat, thus providing an effective surface for scraping. In the illustrated embodiment, as shown in FIG. 5B, the bowl 112 has a substantially elongated pentagonal shape with rounded corners.

Figure 5C:
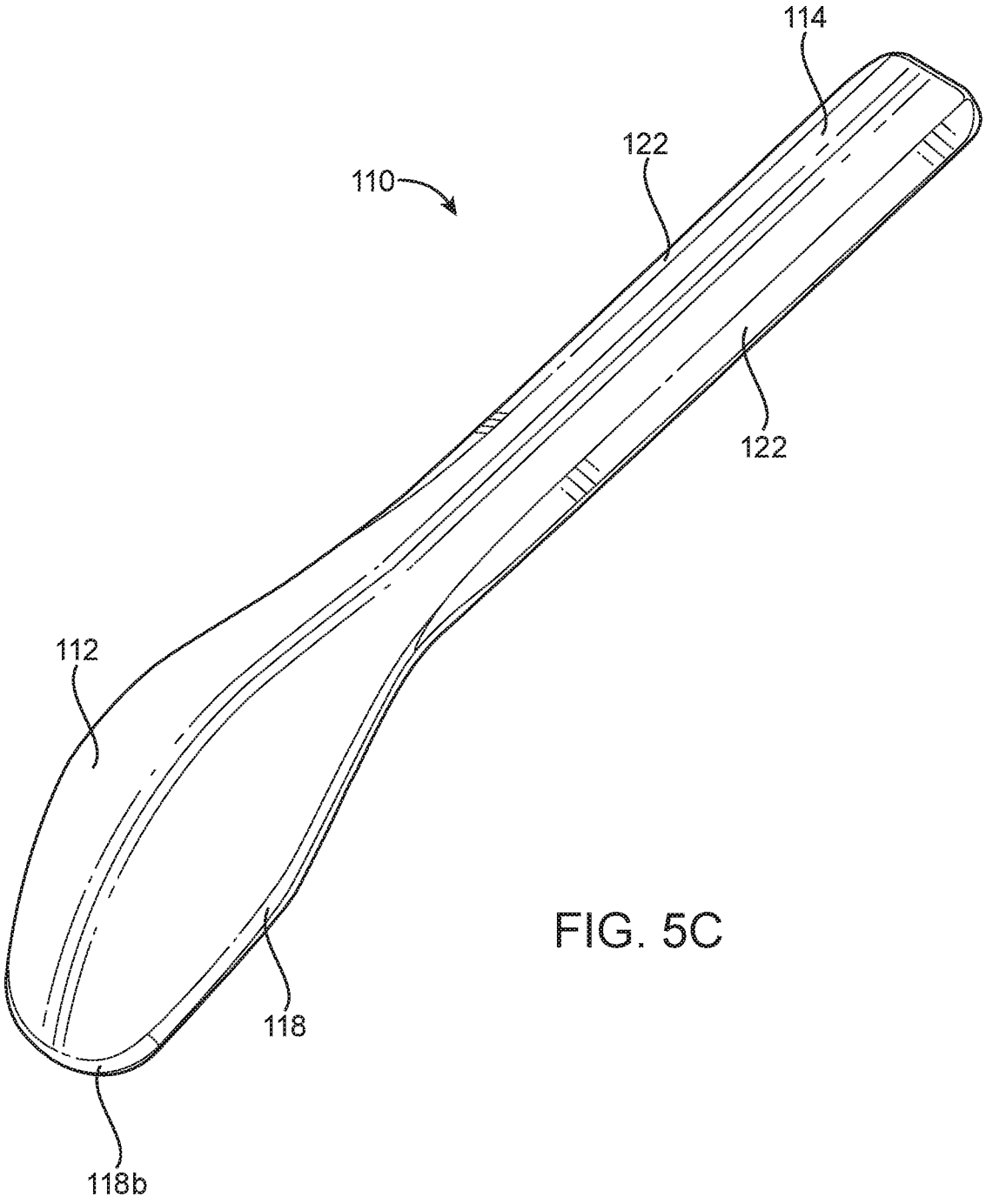
FIG. 5C is a bottom perspective view of the spoon shown in FIGS. 5A and 5B.
Figure 5D:
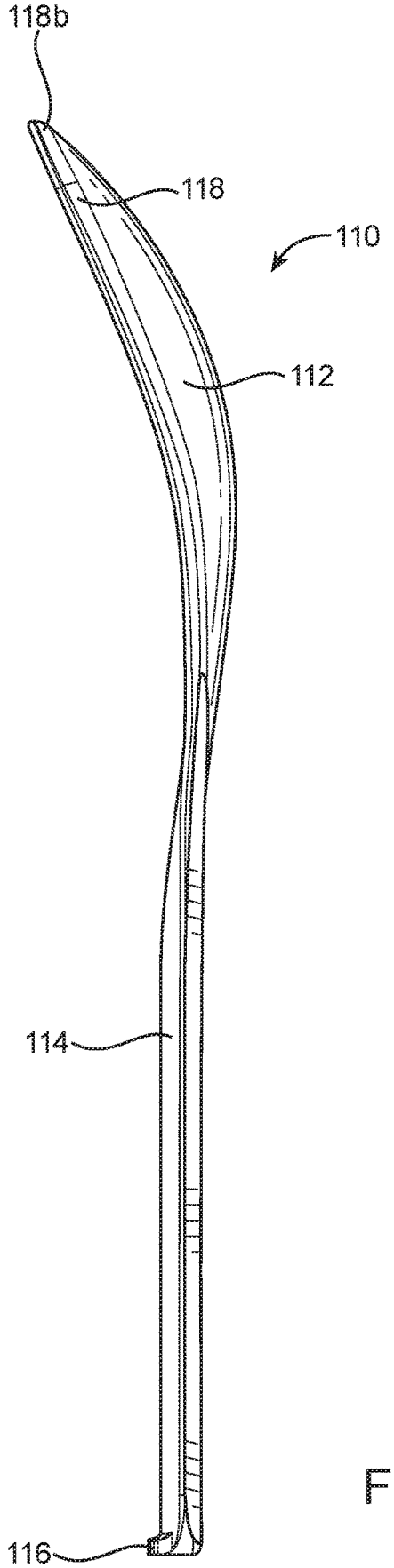
FIG. 5D is a side view of the spoon shown in FIGS. 5A-5C.

Also, as shown in the side view of FIG. 5D, the bowl 112 is angled upward to form a deeper bowl, which can be more efficient when scooping liquids, such as soups. In a particular embodiment, the bowl is angled upward at an angle of about 20-25 degrees, and preferably about 23 degrees. It will be noted that the spoon 110 has a deeper bowl 112 than the corresponding head portion 141 of the fork 140 so that the fork 140 can be nested on top of the spoon 110 in the nested position.

In the illustrated embodiment, the bottom surface of each of the edges 122 of the handle 114 of the spoon 110 is tapered or chamfered so that the edge 122 can be used as a splitter or cutter, similar to the outer tines 144 of the fork 140. In the illustrated embodiment as shown in FIG. 5C, the chamfered edge 122 starts at the proximal end of the spoon 110 and extends along the entire length of the spoon handle 114. In a particular embodiment, the edges 122 are chamfered at an angle of about 65-70 degrees, and preferably about 67 degrees, and each edge 122 has a width of about 0.7 mm at its widest point. The width remains substantially the same along the length of the chamfered edge 122 but tapers to end in a point where the spoon handle 114 meets the head portion or bowl 112, as shown in FIG. 5C. Although the spoon head portion or bowl 112 is described above as being connected to or meeting the spoon handle 114, it will be understood that the spoon is formed as an integral piece in this embodiment. In the illustrated embodiment, both edges 122 are chamfered so that both edges 122 can easily be used to cut or separate food regardless of whether the user is right-handed or left-handed.

The taper of the bottom surface edges 122 of the spoon handle 114 also allows for low profile rails 148 on the fork 140, as the edges 122 of the spoon 140 are configured to slide under and between the rails 148 of the fork 140 to either nest the spoon 110 and fork 140 together or to form a longer combination eating utensil. That is, the bottom edges 122 are chamfered at an angle that corresponds to the angle of the bottom surface of the rails 148 on the fork 140. According to an embodiment, the height of the rails is about 1.5-3 mm and the height of the edges 122 is about 0.5-1.75 mm.

The rails 148 are so low profile that when the spoon 110 and fork 140 are interlocked (whether in the nested position or connected in the elongated combination utensil position), the bottom of the spoon bowl 112 actually extends below the bottom of the rails 148, as shown in the side view of FIGS. 3 and 6D.

The spoon 110 and fork 140 are formed of a plastic material, such as a glass reinforced thermoplastic, that is suitable for food contact. A particularly suitable reinforced thermoplastic for forming the spoon 110 and fork 140 is glass filled nylon. Compared with unreinforced nylon, glass filled nylon has increased structural strength and stiffness.

Nested Position

As shown in FIGS. 1-3, the spoon 110 and fork 140 can be nested together for storage and/or transport. In the nested position, the spoon 110 and fork 140 are interlocked with the spoon head 112 and the fork head 141 oriented the same way. An interlocking mechanism can lock the spoon 110 in place relative to the fork 140, as will be described in more detail below.

As described above, there is a recess 150 in the bottom surface of the fork 140 that is configured to receive the top surface spoon handle 114 and its crescent-shaped raised edge 116. To nest the spoon 110 and fork 140 together, the spoon 110 is first positioned underneath the fork 140 in the same orientation (the spoon 110 and fork 140 are both facing up or both facing down) and both pointed in the same direction (the bowl and tines pointed in the same direction), with the raised edge 116 at the proximal end of the spoon positioned in the recess 150 of the fork 140 laterally between the rails 148 and the detent 153 closer to the distal end of the fork 140. The curvature of the crescent-shaped raised edge 116 corresponds to the curvature of the recess 150 such that the raised edge 116 fits nicely in the recess 150.

The raised edge 116 at proximal end of the spoon 110 is then slid laterally along the recess 150 toward the proximal end of the fork 140 while guiding the outer edges of the spoon handle 114 between the rails 148 until the raised edge 116 abuts the gradually sloped face of the detent 152 closer to the proximal end of the fork 140. A greater force is then applied in the same direction to push the raised edge 116 over the gradually sloped face of the detent 152 and over the top of the detent 152 to engage the groove between the detent 152 and the proximal end wall 162 of the recess 150. As the raised edge 116 is pushed over the gradually sloped face of the detent 152, the handle-ends of the spoon 110 and fork 140 are bent away from each other. This bending allows the crescent of the raised edge 116 to ride up and over the detent 152. The distance between the ends of the rails 148 and the detent 152 effectively creates beams in the spoon and fork ends that are made to bend through the pressing or pulling action. It will be appreciated that the snapping force can be tuned by such things as changing the length of the rails and/or the size of the detent. That is, longer rails results in shorter beams making it more difficult to deflect and snap. Conversely, shorter rails result in longer beams making it easier to deflect and snap.

With the detent 152 snapped in the groove between the detent 152 and the proximal end wall 162 of the recess 150, the spoon 110 and fork 140 are interlocked. The end wall 162 acts as a hard stop and prevents the spoon 110 from moving beyond the locked position and the detent 152 prevents the spoon 110 from moving back in the opposite direction to disengage the fork 140. The rails 148 prevent the fork 140 and spoon 110 from being separated in the z-direction.

It will be noted that the crescent shape of the raised edge 116 provides additional surface area to abut the end wall 162 to prevent the spoon 110 from sliding past the locked position. When the raised edge 116 engages the space between the detent 152 and the end wall 162, the spoon 110 and fork 140 are interlocked in the nested position and fairly significant force is required to disengage the spoon 110 and fork 140 from the nested position because the raised edge 116 must move over the top of the detent 152 without the benefit of a gradually sloped face of the detent 152. It will be understood that greater force is necessary to disengage the spoon from the fork than is required to interlock the utensils in the nested position because the detent 152 is gradually sloped leading to the top of the detent 152 from the center of the distal end of the fork 140 whereas the opposite side of the detent 152 opposite the end wall 162 is more steeply angled, as illustrated. The more gradually sloped face of the detent 152 makes it easier for the raised edge 116 to slide up to the top of the detent 152. According to an embodiment, the slope of the gradually sloped face of the detent is at an angle of about 15 degrees. The gradually sloped face can also be formed as a curved surface of about 4 mm radius.

As shown in FIGS. 4F and 4G, there are two detents 152, 153. Each detent has an angled face on both sides. The sides facing together or inward are more gradually sloped, and the sides facing away from each other are steeply sloped. The inward-facing detent angles are more gradually sloped to permit easier nesting of the fork and spoon (as explained above) or extension to form the elongated combination utensil (as explained in more detail below). The outward-facing detent angles are steeper making it more difficult to "un-snap" or disengage the spoon and fork from each configuration.

To disengage the spoon 110 and fork 140 from the interlocked nested position, the spoon 110 and fork 140 can simply be pulled apart from one another in the lateral direction. A particularly convenient way to disengage the spoon 110 and fork 140 from the interlocked nested position is to start with the nested spoon and fork system 100 upside down. Thus, with the bottom of the spoon 110 facing up, a user can hold the handles with a conventional grip while using a thumb to push the bowl 112 toward the distal end to disengage the spoon 110 and fork 140. With enough force applied, the raised edge 116 of the spoon 110 will move over the nub 152 and the raised edge 116 of the spoon 110 can slide along the recess 150 and the spoon handle 114 can slide between the rails 148 until the raised edge 116 is once again between the rails 148 and the nub 152 closer to the distal portion of the fork 140. When the raised edge 116 has moved past the rails 148, the spoon 110 can be disengaged from the fork 140 and separated.

The rails 148 are centered laterally between the detents 152, 153, as shown in FIGS. 4F and 4G. In the illustrated embodiment, the rails 148 are approximately half the length of the recess 150. The length as well as the position of the rails 148 along the handle 146 are important for a properly functioning interlocking mechanism. It will be appreciated that the rails 148 need to have a certain length in order to adequately secure the handles 114, 146 together when the spoon and fork are interlocked. The centering of the rails 148 laterally with respect to the length of the recess 150 and the positioning of the detents 152, 153 is important to allow for the raised edge 116 of the spoon handle 114 to engage the recess 150 at one end of the recess and also for the raised edge 116 to engage the detent on the other end of the recess 150 to snap the spoon and fork in the interlocked position (whether nested or connected end to end to form a combination utensil).

Elongated Combination Utensil

As mentioned above, the spoon 110 and fork 140 can be connected end to end to form an elongated combination utensil having a fork 140 on one end and a spoon 110 on the other end, with an elongated handle in between. Such an elongated utensil can be useful in certain situations, such as stirring food in a pot or eating out of deep containers or bagged foods.

The elongated combination utensil will be described with reference to FIGS. 6A-6D, which represent various views of the spoon 110 and fork 140 connected end to end to form the elongated combination utensil. The interlocking mechanism for forming the elongated combination utensil is the same as that for the nested position except that it operates in the opposite direction, as explained in more detail below.

To assemble the combination utensil, the fork 140 and spoon 110 are positioned facing opposite directions (with the spoon 110 on one end and the fork 140 on the other end) but with the same orientation (both facing up or both facing down). The raised edge 116 of the spoon 110 is then positioned in the recess 150 between the rails 148 and the detent 152 closer to the proximal end of the fork 140. The spoon 110 is then slid toward the distal end of the fork 140, with the crescent-shaped raised edge 116 sliding along the correspondingly shaped recess 150 and the outer edges of the spoon handle 114 between the rails 148. Once the raised edge 116 abuts the gradually sloped face of the detent 153 closer to the distal end of the fork 140, additional force is necessary to push the raised edge 116 up along the angled portion of the detent 153 and over the top of the detent 153 until the raised edge 116 engages the groove between the detent 153 and the distal end wall 163 of the recess 150. With the raised edge 116 engaged in the groove between the detent 153 and the end wall 163, the spoon 110 and fork 140 are interlocked in the elongated combination utensil position.

It will be understood that the end wall 163 acts as a hard stop, preventing the spoon 110 from being slid further. The end wall 163 prevents the spoon 110 from moving beyond the locked position and the detent 153 prevents the spoon 110 from moving back in the opposite direction to disengage the fork 140. The rails 148 not only prevent the fork 140 and spoon 110 from being separated in the z-direction, but also prevent the fork and spoon from being separated by bending (both side-to-side and top-to-bottom bending) as well by torsion or twisting forces.

When the raised edge 116 engages the groove between the detent 153 and the distal end wall 163 of the recess 150, the spoon 110 and fork 140 are interlocked in the combination utensil position and fairly significant force is required to disengage the spoon 110 and fork 140 from this position. To disengage the spoon 110 and fork 140, with the spoon 110 and fork 140 are simply pulled apart in the lateral direction. With enough force applied, the gradually sloped face of the detent 153 exerts a normal force on the ends of the handles 114, 146, thereby bending them and allowing the raised edge 116 of the spoon 110 to move over the top of the detent 153. The spoon 110 can then slide along the recess 150 between the rails 148 until the raised edge 116 is once again positioned laterally between the rails 148 and the detent 152 closer to the proximal portion of the fork 140. When the raised edge 116 has moved laterally past the rails 148, the spoon 110 can be disengaged from the fork 140 and separated. It will be understood that greater force is necessary to disengage the spoon from the fork than is required to interlock the utensils because the detent 153 is more gradually sloped leading to the top of the detent 153 from the center of the proximal end of the fork 140 whereas the opposite face of the detent 153 opposite the end wall 163 is more steeply sloped. According to an embodiment, the gradually sloped face of the detent is at an angle of about 15 degrees.

Figure 6A:
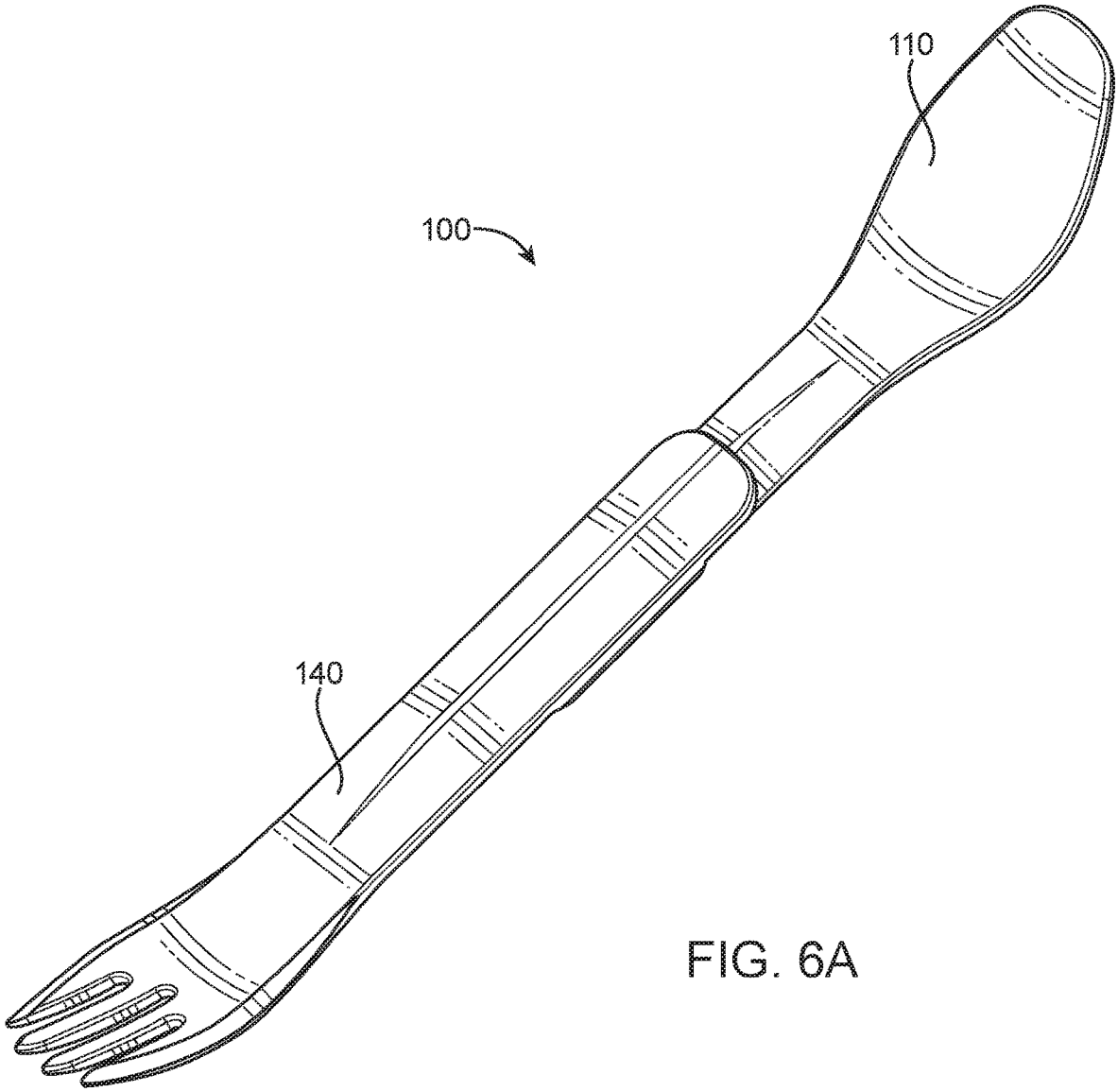
FIG. 6A is a perspective view of the combination spoon and fork system in the elongated combination utensil position in accordance with an embodiment.
Figure 6B:
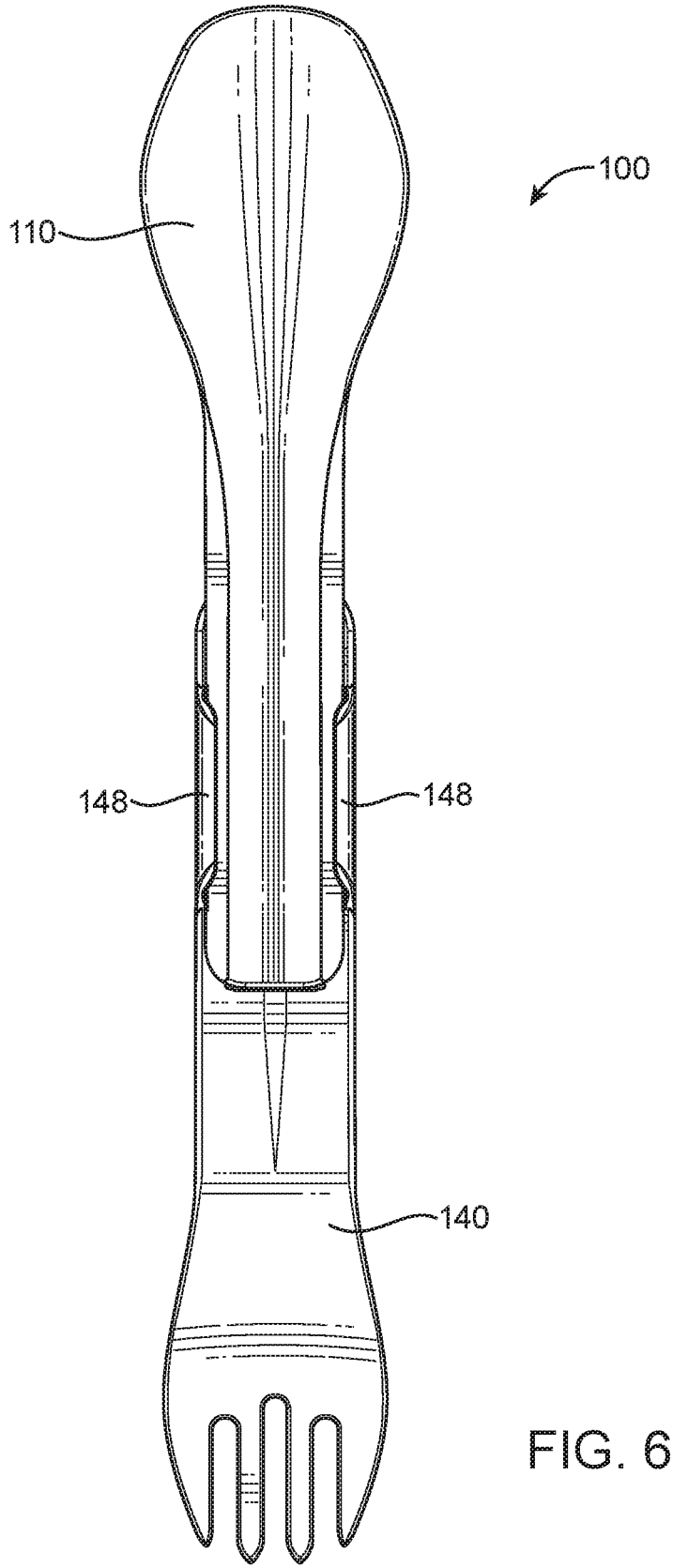
FIG. 6B is a bottom plan view of the embodiment shown in FIG. 6A.
Figure 6C:
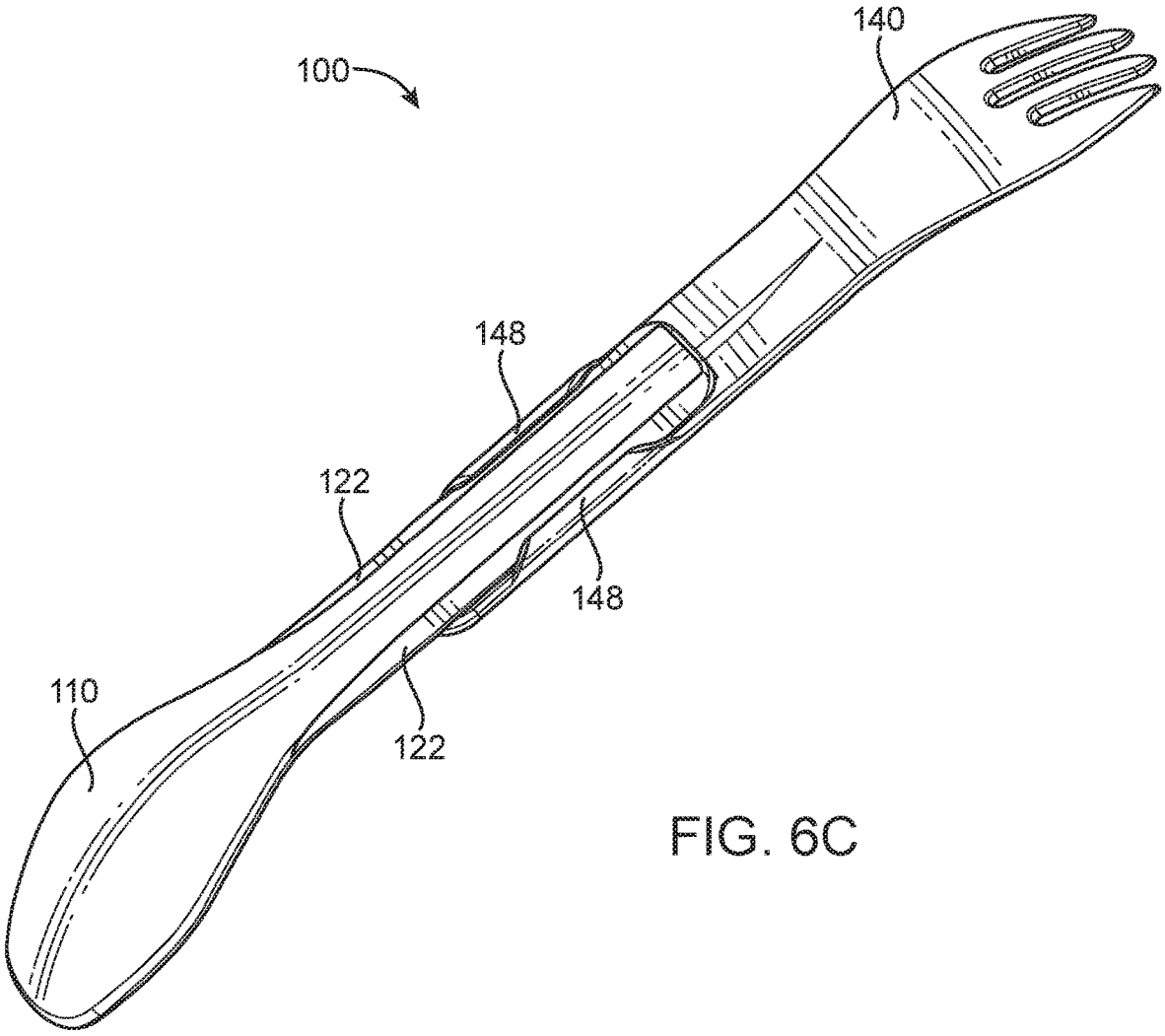
FIG. 6C is a bottom perspective view of the embodiment shown in FIGS. 6A and 6B.
Figure 6D:
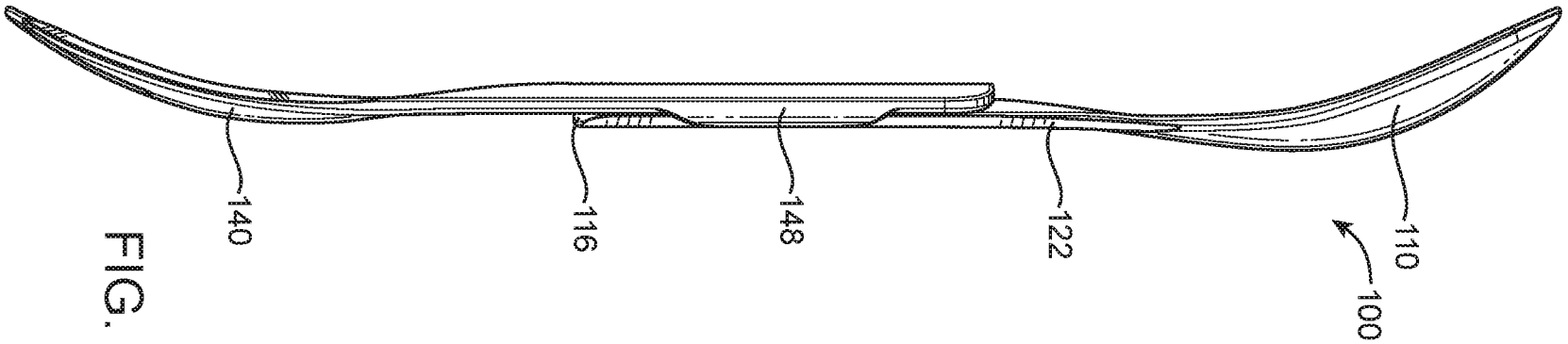
FIG. 6D is a side view of the embodiment shown in FIGS. 6A-6C.

As noted above, the spoon 110 and fork 140 are oriented in the same direction (with both heads 141, 112 facing up or both facing down) when connected end to end such that the combination spoon and fork system 100 has a substantially wide U-shaped configuration, as shown in FIG. 6D. It will be appreciated that the U-shaped configuration is comfortable for a user to hold and manipulate. With the spoon head 112 and the fork head 141 oriented the same way, the fork head 141 does not get in the way of the user's hand when the combination utensil is being used as a spoon and when the combination utensil is being used as a fork, the spoon head 112 does not get in the way of the user's hand.

Integral Combination Utensil

Figure 7A:
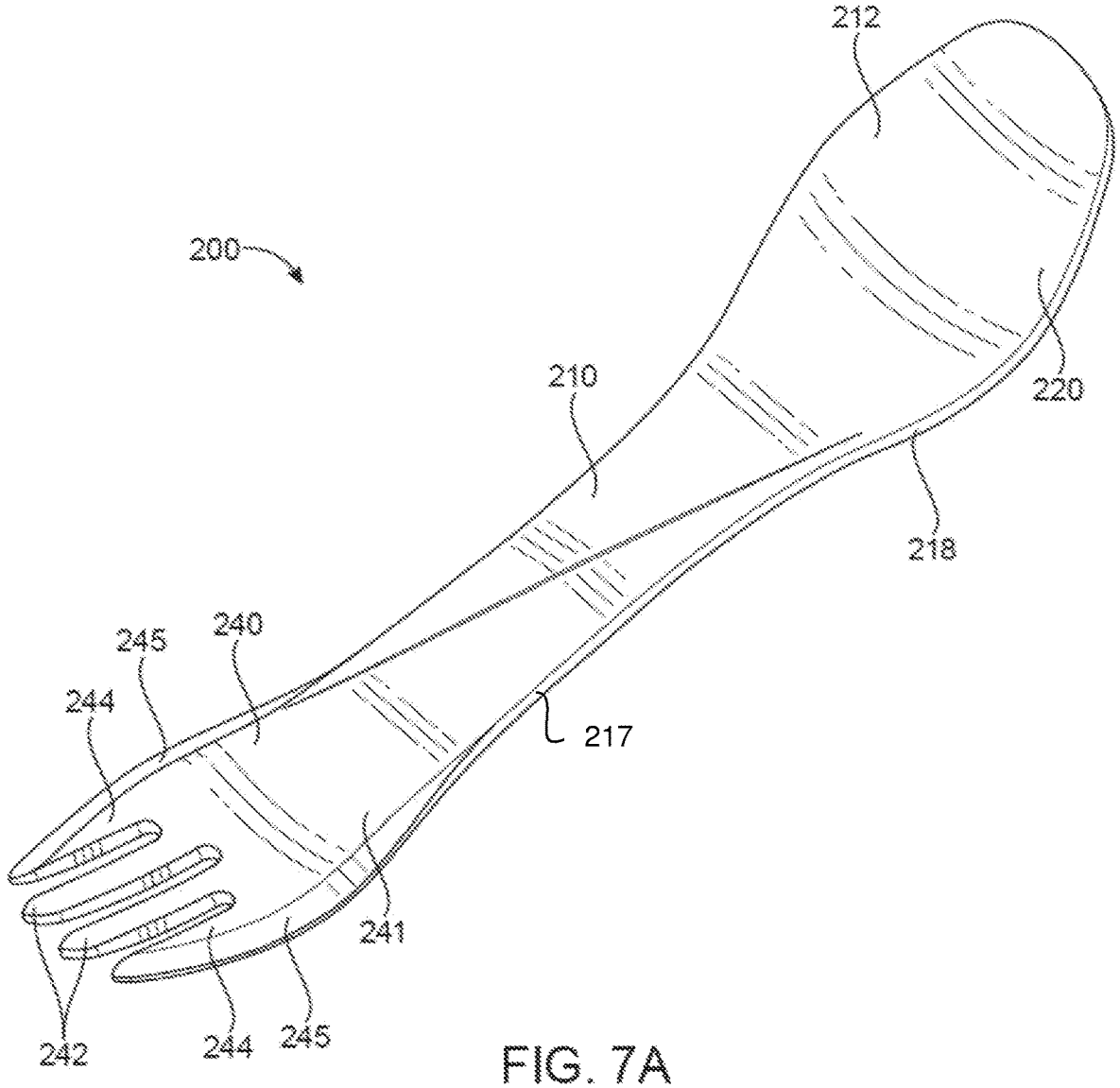
FIG. 7A is a top perspective view of an integral combination utensil in accordance with an embodiment.
Figure 7B:
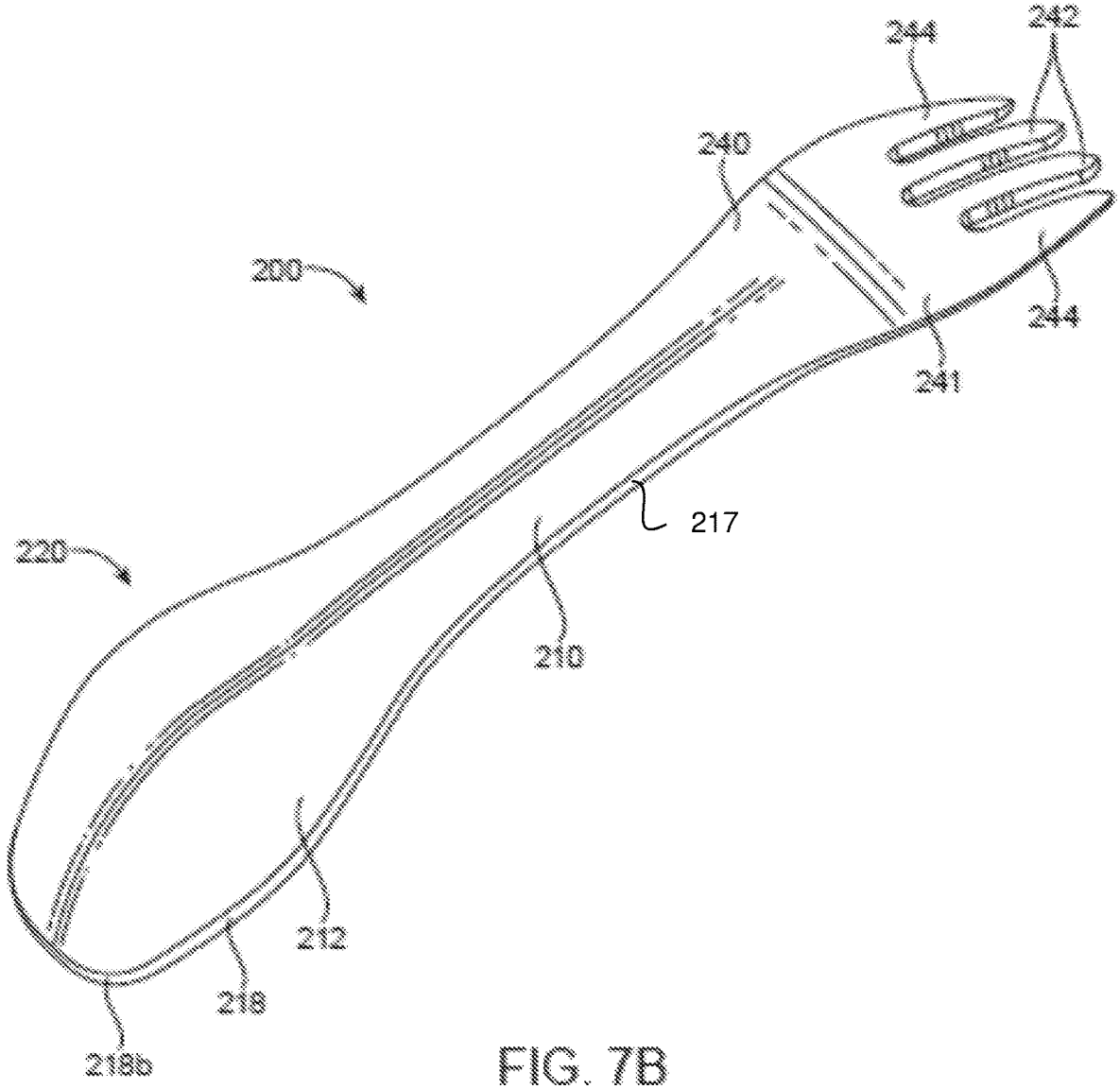
FIG. 7B is a bottom perspective view of the integral combination utensil shown in FIG. 7A.
Figure 7C:
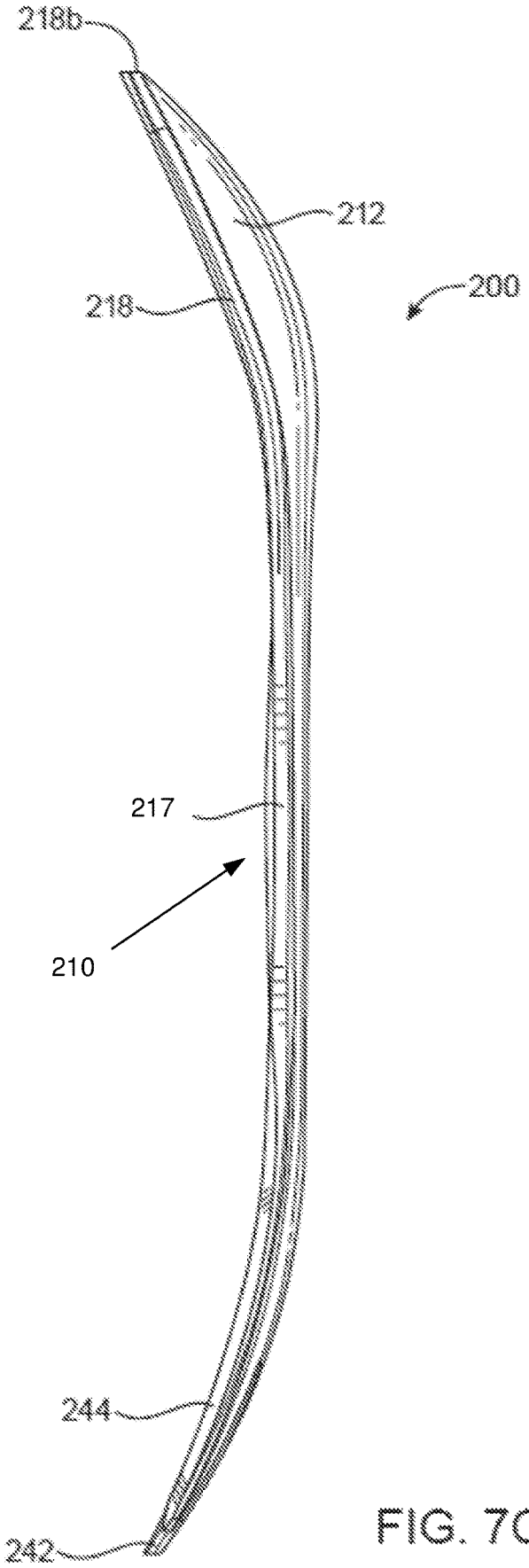
FIG. 7C is a side view of the integral combination utensil shown in FIGS. 7A and 7B.

According to another embodiment, an integral combination fork and spoon utensil 200 is shown in FIGS. 7A-7C. This embodiment is related to concurrently filed U.S. Design application Ser. No. 29/484,553, which is incorporated herein by reference. This embodiment is similar to the elongated combination utensil shown in FIGS. 6A-6D except that this embodiment is formed as a single integral unit. The handle 210 is positioned laterally between a spoon 220 on one end and a fork 240 on the other end.

The fork 240 has a head portion 241, which includes the tines, that is connected to handle 210. In the illustrated embodiment, the fork 240 has two substantially straight center tines 242. The two outer tines 244 each have a substantially straight inner edge and a curved outer edge 245. The curvature of the outer edges 245 can also be used for scraping food from a container, as the curved edges 245 follow the curvature of a curved container, such as a bowl, better than the straight tines of many conventional forks. In the illustrated embodiment, the fork 240 has four tines 242, 244. It will be understood that, in other embodiments, the fork can have more or fewer tines. Each tine 242, 244 has a pointed tip, which aids in spearing or piercing pieces of food so that the food can be picked up by the fork 240.

In addition to being curved, the outer edges 245 of the two outer tines 244 are also tapered or chamfered such that the fork 240 can be used to cut through or separate foods that do not require a knife. As illustrated in FIG. 7A, the top surface of each of the outer edges 245 is tapered or chamfered. As illustrated in FIG. 7A, the top surface of each of the curved outer edges 245 is tapered or chamfered. As illustrated, each chamfered edge 245 has one end at the pointed tip of the outer tine 244 and extends along the outer curved edge of the outer tine 244 to the position where the fork head 241 meets the handle 210. As shown in FIG. 7A, the chamfered edge 245 spans the entire width of the outer tine 244 at the pointed tip. As the chamfered edge 245 extends down along the curved outer edge of the outer tine 244, the width of the chamfered edge 145 remains substantially the same until it begins to taper toward the end of the fork head 241. In the illustrated embodiment, the chamfered edge 245 tapers and ends in a point where the fork head 241 meets the handle 210. In a particular embodiment, the outer edges 245 are chamfered at an angle of about 20-25 degrees, and preferably about 23 degrees, and the chamfered edge has a width of about 1 mm. In the illustrated embodiment, the outer edges 245 of both outer tines 244 are chamfered so that both outer edges 245 can easily be used to cut or separate food regardless of whether the user is right-handed or left-handed. In the illustrated embodiment, the center tines 242 are longer than and extend further distally than the outer tines 244, thereby forming a curve at the distal end of the fork 240 when viewed from the top.

The spoon 220 has a head portion or bowl 212 on its distal end. The bowl 212 of the spoon 220 has a substantially flat side edge 218 and end edge 218*b*, which allows for "scraping" food from of a container (e.g., a yogurt container) or a bowl. As shown in the side view of FIG. 7C, the bowl 212 is angled upward to form a deeper bowl, which can be more efficient when scooping liquids, such as soups. In a particular embodiment, the bowl 212 is angled upward at an angle of about 20-25 degrees, and preferably about 23 degrees. In the illustrated embodiment, the bowl 212 has a substantially elongated pentagonal shape with rounded corners. The substantially flat side edge 218 of the bowl 212 forms a portion of a side surface 217 or edge of the utensil 200. As shown in FIGS. 7A-7C, the side surface 217 of the utensil 200 extends continuously along the entire length of the utensil 200, from the distal tip of an outer tine 244 to the distal tip or end of the spoon bowl 212. As shown in FIG. 7A, the chamfered outer edge 245 is chamfered at an angle from the side surface 217.

It will be noted that the integral combination fork and spoon utensil 200 can be formed with a handle of any desired length. That is, the handle can be a standard length, or if desired, the handle can be shorter or elongated. In a particular embodiment, the handle has a length of about 165 mm. Similar to the elongated combination utensil described above, the integral combination utensil also has a substantially wide U-shaped configuration with the spoon 210 and fork 240 are oriented in the same direction (with both heads 241, 212 facing up or both facing down) when connected end to end such that the integral combination spoon and fork system 200 has a substantially wide U-shaped configuration, as shown in FIG. 7C. As noted above, the substantially U-shaped configuration is comfortable for a user to hold and manipulate. With the spoon head 212 and the fork head 241 oriented the same way, the fork head 241 does not get in the way of the user's hand when the integral combination utensil is being used as a spoon. When the integral combination utensil is being used as a fork, the spoon head 212 does not get in the way of the user's hand.

Although only a few embodiments of the invention have been described in detail, it should be appreciated that the invention may be implemented in many other forms without departing from the spirit or scope of the invention. In view of all of the foregoing, it should be apparent that the present embodiments are illustrative and not restrictive and the invention is not limited to the details given herein, but may be modified within the scope and equivalents of the appended claims.

What is claimed is:

1. An eating utensil comprising:

a fork head having a fork front surface and a fork back surface both partially defining a plurality of tines and a concave fork bowl portion, an outer one of the tines and the concave fork bowl portion being further defined by a chamfer and a curved side surface coupled to the chamfer, the chamfer coupling the fork front surface with the curved side surface, the curved side surface coupling the chamfer with the fork back surface, the chamfer is oblique in relation to the curved side surface and the coupling between the chamfer and the curved side surface defines of a curved splitting feature;

a spoon head having a spoon front surface, a spoon back surface, and a spoon side surface coupling the spoon front surface with the spoon back surface, the spoon front surface, the spoon back surface, and the spoon side surface partially defining a concave spoon bowl portion, the spoon bowl portion facing a same way as the concave fork bowl portion;

a handle that couples the spoon head to the fork head, the handle having a handle front surface, a handle back surface, and a handle side surface coupling the handle front surface to the handle back surface;

the fork front surface, the spoon front surface, and the handle front surface collectively defining a single front surface of the utensil;

the fork back surface, the spoon surface, and the handle back surface collectively defining a single back surface of the utensil; and the fork side surface, the spoon side surface, and the handle side surface collectively defining a single side surface of the utensil.

2. An eating utensil as recited in claim 1, wherein inner ones of the plurality of tines each has a pair of substantially straight side edges and a pointed distal tip.

3. An eating utensil as recited in claim 2, wherein the outer one of the tines has a wider base end than the inner ones of the tines.

4. An eating utensil as recited in claim 1, wherein the concave spoon bowl portion is further defined by at least three substantially flat side edges with rounded corners connecting the flat side edges, wherein one of the flat side edges further defines the single side surface of the utensil.

5. An eating utensil as recited in claim 1, wherein the concave spoon bowl portion is tilted at a first angle relative to the handle front surface and the concave fork bowl portion is tilted at a second angle relative to the handle front surface such that at least a portion of each of the bowl portions extend forward from the handle front surface.

6. An eating utensil as recited in claim 1, wherein the concave spoon bowl portion is further defined by a plurality of substantially flat side edges, wherein one of the substantially flat side edges further defines the single side surface of the utensil.

7. An eating utensil as recited in claim 1, wherein the eating utensil is formed of a glass reinforced thermoplastic material.

8. An eating utensil formed from a glass filled nylon thermoplastic material, the eating utensil comprising:

a fork head having a fork front surface and a fork back surface both partially defining a plurality of tines and a concave fork bowl portion, a first outer one of the tines and the concave fork bowl portion being further defined by a first chamfer and a first curved side surface coupled to the first chamfer, the first chamfer coupling the fork front surface with the first curved side surface, the first curved side surface coupling the first chamfer with the fork back surface, the first chamfer is oblique in relation to the first curved side surface and the coupling between the first chamfer and the first curved side surface defines a first curved splitting feature, a second outer one of the tines and the concave fork bowl portion being further defined by a second chamfer and a second curved side surface coupled to the second chamfer, the second chamfer coupling the fork front surface with the second curved side surface, the second curved side surface coupling the second chamfer with the fork back surface, the second chamfer is oblique in relation to the second curved side surface and the coupling between the second chamfer and the second curved side surface defines a second curved splitting feature;

a spoon head having a spoon front surface, a spoon back surface, and first and second spoon side surfaces coupling the spoon front surface with the spoon back surface, wherein the spoon front surface, the spoon back surface, and the first and second spoon side surfaces defining a concave spoon bowl portion, the spoon bowl portion faces the same way as the concave fork bowl portion;

a handle that couples the spoon head to the fork head, the handle having a handle front surface, a handle back surface, and a first and second handle side surface coupling the handle front surface to the handle back surface;

the fork front surface, the spoon front surface, and the handle front surface collectively defining a single front surface of the utensil;

the fork back surface, the spoon back surface, and the handle back surface collectively defining a single back surface of the utensil;

the first fork side surface, the first spoon side surface, and the first handle side surface collectively defining a single first side surface of the utensil; and the second fork side surface, the second spoon side surface, and the second handle side surface collectively defining a single second side surface of the utensil.

9. An eating utensil comprising:

a first head having a first front surface and a first back surface both partially defining a plurality of tines and a first concave bowl portion, an outer one of the tines and the first concave bowl portion being further defined by a chamfer and a first curved side surface coupled to the chamfer, the chamfer coupling the first front surface with the first curved side surface, the first curved side surface coupling the chamfer with the first back surface, and the chamfer is oblique in relation to the first curved side surface;

a second head having a second front surface, a second back surface, and a second side surface coupling the second front surface with the second back surface, the second front surface, the second back surface, the second side surface partially defining a second concave bowl portion, the second concave bowl portion faces the same way as the first concave bowl portion;

a handle that couples the spoon head to the fork head, the handle having a handle front surface, a handle back surface, and a handle side surface coupling the handle front surface to the handle back surface;

the first front surface, the second front surface, and the handle front surface collectively defining a single front surface of the utensil;

the first back surface, the second back surface, and the handle back surface collectively defining a single back surface of the utensil; and the first side surface, the second side surface, and the handle side surface collectively defining a single side surface of the utensil.

10. The eating utensil as recited in claim 9, wherein the handle, the first head, and the second head are integrally formed.

11. The eating utensil as recited in claim 9, wherein an inner one of the tines is substantially straight.

12. The eating utensil as recited in claim 9, wherein the outer one of the tines is further defined by a substantially straight inner edge.

13. The eating utensil as recited in claim 9, wherein the eating utensil is formed of a glass reinforced thermoplastic material.

14. The eating utensil as recited in claim 9, wherein the second concave bowl portion is further defined by a plurality of substantially flat side edges, wherein one of the substantially flat side edges further defines the single side surface of the utensil.

15. An eating utensil comprising:

a fork head having a fork front surface and a fork back surface both partially defining a plurality of tines and a concave fork bowl portion, an outer one of the tines and the concave fork bowl portion being further defined by a chamfer and a curved side surface coupled to the chamfer, the chamfer coupling the fork front surface with the curved side surface, the curved side surface coupling the chamfer with the fork back surface, the chamfer is oblique in relation to the curved side surface and the coupling between the chamfer and the curved side surface defines a curved splitting feature;

a handle coupled to the fork head, the handle having a handle front surface, a handle back surface, and a handle side surface coupling the handle front surface to the handle back surface;

the fork front surface and the handle front surface defining a single front surface of the utensil;

the fork back surface and the handle back surface defining a single back surface of the utensil; and the fork side surface and the handle side surface defining a single side surface of the utensil.

16. The eating utensil as recited in claim 15, further comprising a spoon head coupled to the handle on an opposite side from where the fork head is coupled to the handle, the spoon head having a spoon front surface, a spoon back surface, and a spoon side surface coupling the spoon front surface with the spoon back surface, wherein the spoon front surface, the spoon back surface, and the spoon side surface defining a concave spoon bowl portion;

the spoon front surface further defining the single front surface of the utensil;

the spoon back surface further defining the single back surface of the utensil; and the spoon side surface further defining the single side surface of the utensil.

17. The eating utensil as recited in claim 16, wherein the concave spoon bowl portion is tilted in relation to the handle front surface at an angle of about 20-25 degrees.

18. The eating utensil as recited in claim 16, wherein the concave spoon bowl portion is further defined by a substantially flat side edge, wherein the substantially flat side edges further defines the single side surface of the utensil.

19. The eating utensil as recited in claim 16, wherein the concave spoon bowl portion is further defined by a substantially flat end edge.

20. The eating utensil as recited in claim 16, wherein the concave spoon bowl portion has a substantially pentagonal shape.

21. The eating utensil as recited in claim 16, wherein the concave spoon bowl portion is further defined by at least three substantially flat side edges with rounded corners connecting the flat side edges, wherein one of the flat side edges further defines the single side surface of the utensil.

22. The eating utensil as recited in claim 15, wherein the handle front surface has a diagonal ridge.

23. The eating utensil as recited in claim 15, wherein the eating utensil is formed of a glass reinforced thermoplastic material.

* * * * *